US009442423B2

(12) United States Patent
Fukamachi

(10) Patent No.: US 9,442,423 B2
(45) Date of Patent: Sep. 13, 2016

(54) DEVELOPING CARTRIDGE CAPABLE OF FACILITATING TONER CIRCULATION AT DEVELOPING ROLLER SUPPORT PORTION

(71) Applicant: Brother Kogyo Kabushiki Kaisha, Nagoya-shi, Aichi-ken (JP)

(72) Inventor: Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/849,770

(22) Filed: Sep. 10, 2015

(65) Prior Publication Data

US 2016/0223944 A1 Aug. 4, 2016

(30) Foreign Application Priority Data

Jan. 30, 2015 (JP) ..... 2015-017788

(51) Int. Cl.
*G03G 15/04* (2006.01)
*G03G 15/08* (2006.01)

(52) U.S. Cl.
CPC ..... *G03G 15/0865* (2013.01); *G03G 15/0875* (2013.01); *G03G 15/0896* (2013.01); *G03G 2215/068* (2013.01)

(58) Field of Classification Search
CPC ..... G03G 15/0865; G03G 15/0875; G03G 15/0896; G03G 2215/068
USPC ..... 399/119
See application file for complete search history.

(56) References Cited

U.S. PATENT DOCUMENTS 6,343,192 B1 1/2002 Miyabe et al.
2001/0033757 A1 10/2001 Sato
2006/0133847 A1 6/2006 Burton
2011/0013929 A1* 1/2011 Kim ..... G03G 15/0896 399/103
2011/0158687 A1* 6/2011 Mori ..... G03G 21/1814 399/119

FOREIGN PATENT DOCUMENTS

JP 2011-133757 A 7/2011
JP 2011-133761 A 7/2011

OTHER PUBLICATIONS

Sep. 10, 2015—Co-pending U.S. Appl. No. 14/849,809.
Feb. 29, 2016—(US) Non-Final Office Action—U.S. Appl. No. 14/849,809.

* cited by examiner

*Primary Examiner* — David Gray
*Assistant Examiner* — Tyler Hardman
(74) *Attorney, Agent, or Firm* — Banner & Witcoff, Ltd.

(57) ABSTRACT

A developing cartridge includes: a first frame; and a second frame melt-bonded to the first frame. The first frame includes: a first melt-bonding surface; and a second melt-bonding surface closer to a developing roller than the first melt-bonding surface. The second frame includes: a third melt-bonding surface; a fourth melt-bonding surface; and a center surface facing the first frame. The center surface is closer to an axial center region of the developing roller than the fourth melt-bonding surface in the axial direction. The center surface has a first center surface and a second center surface closer to the developing roller than the first center surface in the first direction. The second center surface forms an obtuse angle with the first center surface and is separated from the first frame farther than the fourth melt-bonding surface in a direction perpendicular to the fourth melt-bonding surface.

21 Claims, 14 Drawing Sheets

DEVELOPING CARTRIDGE CAPABLE OF FACILITATING TONER CIRCULATION AT DEVELOPING ROLLER SUPPORT PORTION

CROSS REFERENCE TO RELATED APPLICATION

This application claims priority from Japanese Patent Application No. 2015-017788 filed Jan. 30, 2015. The entire content of the priority application is incorporated herein by reference.

TECHNICAL FIELD

The present disclosure relates to a developing cartridge to be assembled in an electro-photographic type image forming apparatus.

BACKGROUND

One conventional developing cartridge mountable in an electro-photographic type image forming apparatus includes a developing agent accommodating portion for accommodating therein developing agent (e.g. toner), a developing roller, and a roller support portion for supporting the developing roller.

One such developing cartridge also includes a cartridge frame including a first frame constituting a lower portion of the cartridge frame, and a second frame constituting an upper portion of the cartridge frame. The second frame is melt-bonded (or welded) to the first frame. In the roller support portion, the melt-bonding portions between the first and second frames are inclined downward toward the developing roller. Further, the roller support portion has a reinforcing portion extending in an axial direction of the developing roller at a position between the melt-bonding portions facing with each other.

SUMMARY

Since the reinforcing portion is positioned between the melt-bonding portions inclined diagonally downward, a vertical space at the roller support portion is gradually decreased toward the developing roller.

Therefore, toner may be deposited near the developing roller to cause property change of toner if high speed printing is carried out.

In view of the foregoing, it is an object of the disclosure to provide a developing cartridge capable of facilitating toner circulation at a developing roller support portion.

In order to attain the above and other objects, according to one aspect, the disclosure provides a developing cartridge including: a developing roller; a first frame; and a second frame. The developing roller has an axis extending in an axial direction and an axial center region in the axial direction. The first frame includes a toner accommodating portion and a developing roller support portion. The toner accommodating portion has an edge portion extending in a first direction perpendicular to the axial direction. The developing roller support portion supports the developing roller and is in communication with the toner accommodating portion. The first frame includes: a first melt-bonding surface extending along the edge portion of the toner accommodating portion; and a second melt-bonding surface positioned closer to the developing roller than the first melt-bonding surface to the developing roller. The second melt-bonding surface forms a first obtuse angle with the first melt-bonding surface. The second frame covers the toner accommodating portion and the developing roller support portion. The second fame is melt-bonded to the first frame. The second frame includes: a third melt-bonding surface facing the first melt-bonding surface and melt-bonded to the first melt-bonding surface; a fourth melt-bonding surface facing the second melt-bonding surface and melt-bonded to the second melt-bonding surface; and a center surface facing the first frame and extending in the axial direction. The center surface is positioned closer to the axial center region of the developing roller than the fourth melt-bonding surface to the axial center region of the developing roller with respect to the axial direction. The center surface has a first center surface extending in the first direction and a second center surface positioned closer to the developing roller than the first center surface to the developing roller with respect to the first direction. The second center surface forms a second obtuse angle with the first center surface. The second center surface is separated from the first frame farther than the fourth melt-bonding surface from the first frame with respect to a direction perpendicular to the fourth melt-bonding surface.

According to another aspect, the disclosure provides a developing cartridge including: a developing roller; a base frame; and a cover frame. The base frame supports a developing roller and has a box shape. The base frame includes: a first base welding surface; a second base welding surface; a third base welding surface; and a fourth base welding surface. The second base welding surface is positioned closer to the developing roller than the first base welding surface to the developing roller. The second base welding surface forms a first obtuse angle with the first base welding surface. The fourth base welding surface is positioned closer to the developing roller than the third base welding surface to the developing roller. The fourth base welding surface forms the first obtuse angle with the third base welding surface. The cover frame has a flat plate shape. The cover frame includes: a first cover welding surface; a second cover welding surface; a third cover welding surface; a fourth cover welding surface; a first center surface; and a second center surface. The first cover welding surface faces the first base welding surface and is welded to the first base welding surface. The second cover welding surface faces the second base welding surface and is welded to the second base welding surface. The second cover welding surface forms a third obtuse angle with the first cover welding surface. The third cover welding surface faces the third base welding surface and is welded to the third base welding surface. The fourth cover welding surface faces the fourth base welding surface and is welded to the fourth base welding surface. The fourth cover welding surface forms the third obtuse angle with the third cover welding surface. The first center surface faces the base frame and is positioned between the second cover welding surface and the fourth cover welding surface. The second center surface faces the base frame and is positioned between the second cover welding surface and the fourth cover welding surface and closer to the developing roller than the first center surface to the developing roller. The second center surface forms a second obtuse angle with the first center surface. The second center surface is separated from the base frame farther than the second cover welding surface from the base frame with respect to a direction perpendicular to the second cover welding surface. The second obtuse angle is greater than the third obtuse angle.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
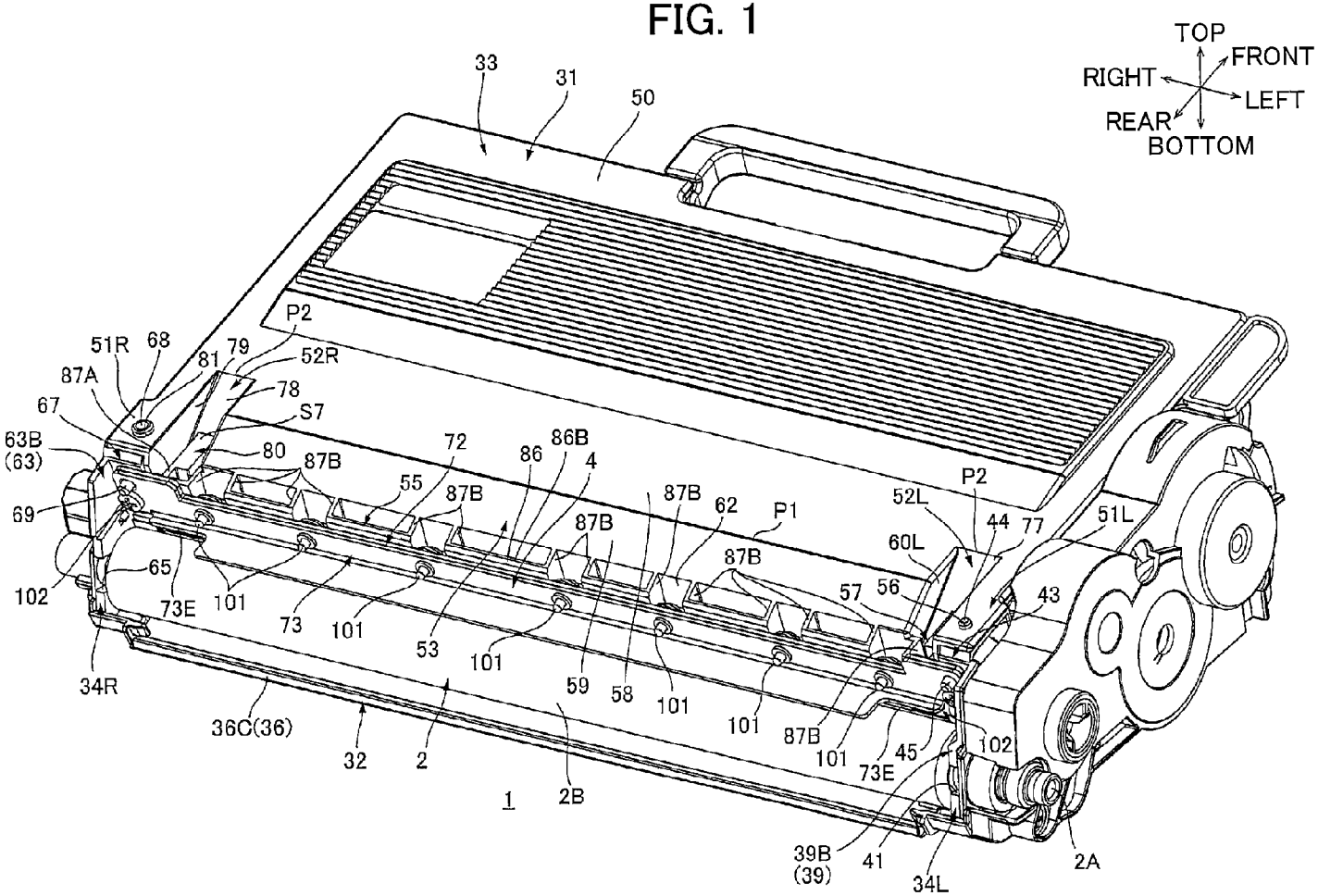
FIG. 1 is a perspective view of a developing cartridge according to one embodiment as viewed from an upper rear side thereof.

A developing cartridge 1 according to one embodiment will be described with reference to the accompanying drawings, wherein like parts and components are designated by the same reference numerals to avoid duplicating description.

1. Overall Structure of Developing Cartridge

Figure 2:
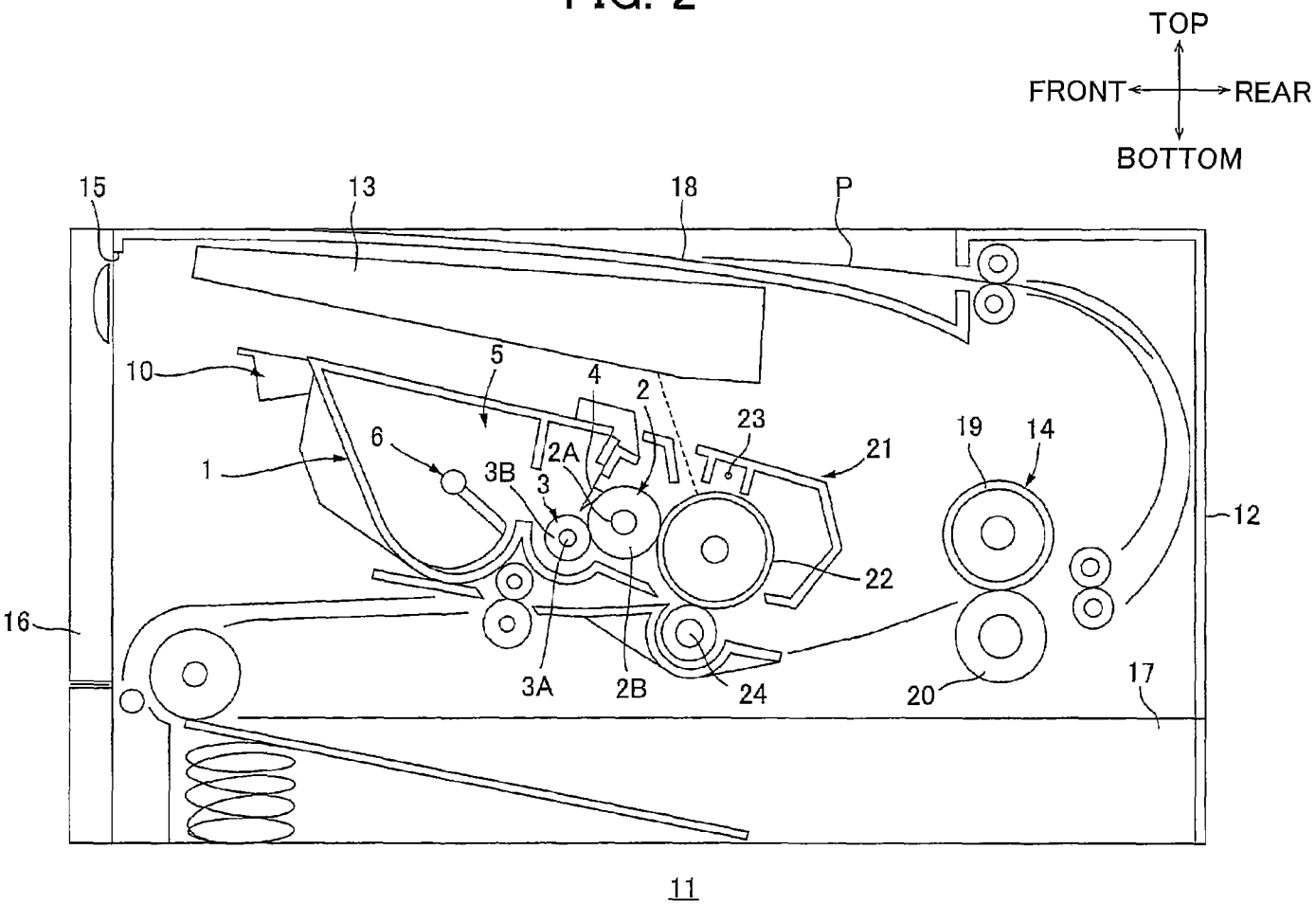
FIG. 2 is a schematic central cross-sectional view of an image forming apparatus in which the developing cartridge illustrated in FIG. 1 is mounted.

As illustrated in FIGS. 1 and 2, the developing cartridge 1 includes a developing roller 2, a supply roller 3, a blade 4, and a toner accommodating portion 5.

The developing roller 2 extends in a prescribed direction. In the depicted embodiment, the extending direction of the developing roller 2 will be referred to as a "left-right direction". Further, on the basis of the left-right direction, a "vertical direction" and a "front-rear direction" will be used in the following description related to the developing cartridge 1, as best illustrated in FIG. 1.

The developing roller 2 is rotatably supported to a rear end portion of a developing frame 31 of the developing cartridge 1. The developing roller 2 includes a developing roller shaft 2A and a roller portion 2B.

The developing roller shaft 2A is columnar and extends in the left-right direction. The developing roller shaft 2A is made from metal.

The roller portion 2B is cylindrical and extends in the left-right direction. The roller portion 2B is made from an electrically conductive rubber. The roller portion 2B covers a left-right intermediate portion of the developing roller shaft 2A, while left and right end portions of the developing roller shaft 2A are not covered with the roller portion 2B.

The supply roller 3 is positioned forward and downward of the developing roller 2. The supply roller 3 is rotatably supported to the developing frame 31 of the developing cartridge 1. The supply roller 3 includes a supply roller shaft 3A and a roller portion 3B.

The supply roller shaft 3A is columnar and extends in the left-right direction. The supply roller shaft 3A is made from metal.

The roller portion 3B is cylindrical and extends in the left-right direction. The roller portion 3B is made from an electrically conductive sponge. The roller portion 3B covers a left-right intermediate portion of the supply roller shaft 3A, while left and right end portions of the supply roller shaft 3A are not covered with the roller portion 3B. The roller portion 3B is in contact with a lower front portion of the roller portion 2B of the developing roller 2.

The blade 4 is positioned forward and upward of the developing roller 2. The blade 4 is in contact with a front end portion of the roller portion 2B of the developing roller 2.

The toner accommodating portion 5 is positioned forward of the supply roller 3 and the blade 4. The toner accommodating portion 5 is configured to accommodate therein toner. The toner accommodating portion 5 is provided with an agitator 6.

The agitator 6 extends in the left-right direction and is rotatably supported in the toner accommodating portion 5.

2. Mode of Use for Developing Cartridge

As illustrated in FIG. 2, the developing cartridge 1 is installed in an image forming apparatus 11. Note that directions related to the image forming apparatus 11 will be given based on a state of the image forming apparatus 11 when the image forming apparatus 1 is resting on a level surface. When the developing cartridge 1 is mounted in the image forming apparatus 11, the front side of the developing cartridge 1 faces the upper front side of the image forming apparatus 11, and the rear side of the developing cartridge 1 faces the lower rear side of the image forming apparatus 11, as illustrated in FIG. 2. Thus, the vertical and front-rear directions related to the image forming apparatus 11 differ slightly from those related to the developing cartridge 1.

The image forming apparatus 11 is an electro-photographic type monochromatic printer. The image forming apparatus 11 includes a main casing 12, a process cartridge 10, a scanner unit 13, and a fixing unit 14.

The main casing 12 is box-shaped whose front end is formed with an opening 15. The main casing 12 includes a front cover 16, a sheet tray 17, and a discharge tray 18.

The opening 15 allows communication between outside and inside of the main casing 12 in the front-rear direction, so that the process cartridge 10 can pass through the opening 15.

The front cover 16 is provided at the front end of the main casing 12. The front cover 16 is plate-shaped. The front cover 16 extends in the vertical direction whose lower end portion is pivotally supported to a front wall of the main casing 12 so that the front cover 16 is pivotally movable about the lower end portion. Thus, the front cover 16 is configured to open and close the opening 15.

The sheet tray 17 is positioned at a bottom portion of the main casing 12. The sheet tray 17 is configured to accommodate sheets P.

The discharge tray 18 is positioned at a front half portion of an upper wall of the main casing 12. The discharge tray 18 is recessed downward from an upper surface of the main casing 12 so as to receive the sheets P.

The process cartridge 10 is configured to be accommodated at a vertically center portion in the main casing 12. The process cartridge 10 can be attached to and detached from the main casing 12 through the opening 15. The process cartridge 10 includes a drum cartridge 21 and the developing cartridge 1 described above.

The drum cartridge 21 includes a photosensitive drum 22, a scorotron charger 23, and a transfer roller 24.

The photosensitive drum 22 is rotatably supported to a rear end portion of a frame of the drum cartridge 21. The photosensitive drum 22 is cylindrical and extends in the left-right direction.

The scorotron charger 23 is positioned upward of the photosensitive drum 22, and is spaced away from the photosensitive drum 22.

The transfer roller 24 is positioned below the photosensitive drum 22. The transfer roller 24 is in contact with a lower end portion of the photosensitive drum 22.

The developing cartridge 1 is positioned forward of the photosensitive drum 22 such that the developing roller 2 is in contact with a front end portion of the photosensitive drum 22.

The scanner unit 13 is positioned above the process cartridge 10. The scanner unit 13 is adapted to emit laser beam based on image data to the photosensitive drum 22.

The fixing unit 14 is positioned rearward of the process cartridge 10. The fixing unit 14 includes a heat roller 19 and a pressure roller 20 in pressure contact with a lower end portion of the heat roller 19.

Upon start of an image forming operation in the image forming apparatus 11, the scorotron charger 23 uniformly charges a surface of the photosensitive drum 22, and the surface of the photosensitive drum 22 is exposed to light by the scanner unit 13. Thus, an electrostatic latent image based on the image data is formed on the surface of the photosensitive drum 22.

In the meantime, the agitator 6 agitates toner in the toner accommodating portion 5 and supplies the toner to the supply roller 3. The supply roller 3 supplies the toner that has been supplied by the agitator 6 to the developing roller 2. At this time, triboelectric charging is performed between the developing roller 2 and the supply roller 3 so that the toner is charged with positive polarity. The toner is then carried on the developing roller 2. The blade 4 regulates thickness of a layer of the toner carried on the developing roller 2 into a uniform thickness.

The toner carried on the developing roller 2 is supplied to the electrostatic latent image formed on the photosensitive drum 22. Thus, a toner image is carried on the surface of the photosensitive drum 22.

Each sheet P is supplied from the sheet tray 17 to a position between the photosensitive drum 22 and the transfer roller 24 at a prescribed timing by rotation of various rollers. The toner image carried on the surface of the photosensitive drum 22 is transferred onto the sheet P when the sheet P passes through the position between the photosensitive drum 22 and the transfer roller 24.

Thereafter, the sheet P is heated and pressed when passing through a position between the heat roller 19 and the pressure roller 20. In this way, the toner image on the sheet P is thermally fixed to the sheet P. Subsequently, the sheet P is discharged onto the discharge tray 18.

3. Detailed Description of Developing Cartridge (1) Developing Frame

Figure 3:
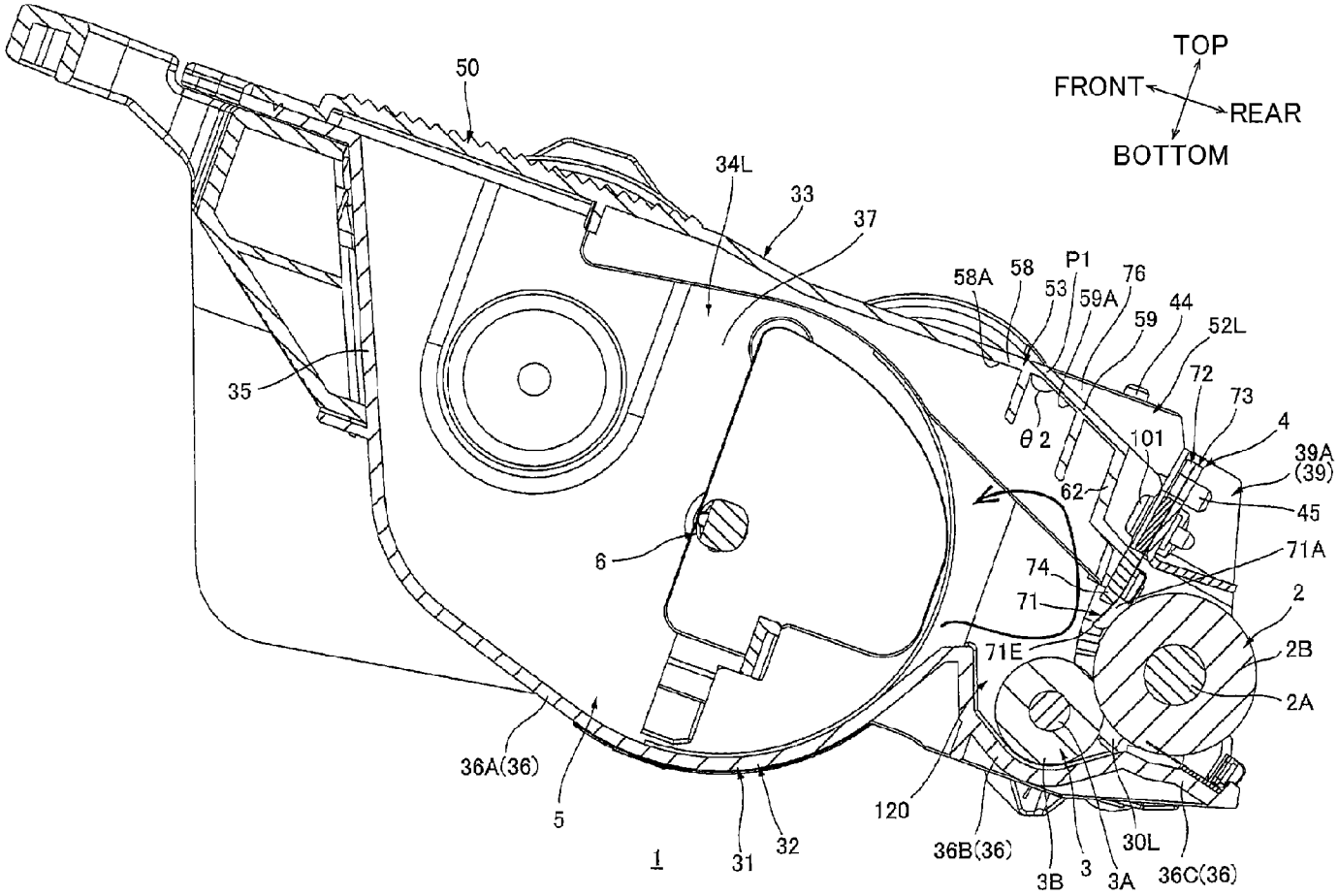
FIG. 3 is a central cross-sectional view of the developing cartridge illustrated in FIG. 1.

As illustrated in FIGS. 1 and 3, the developing cartridge 1 includes the developing frame 31.

The developing frame 31 has a general box shape. The developing frame 31 includes a base frame 32 and a cover frame 33.

(1-1) Base Frame

Figure 5:
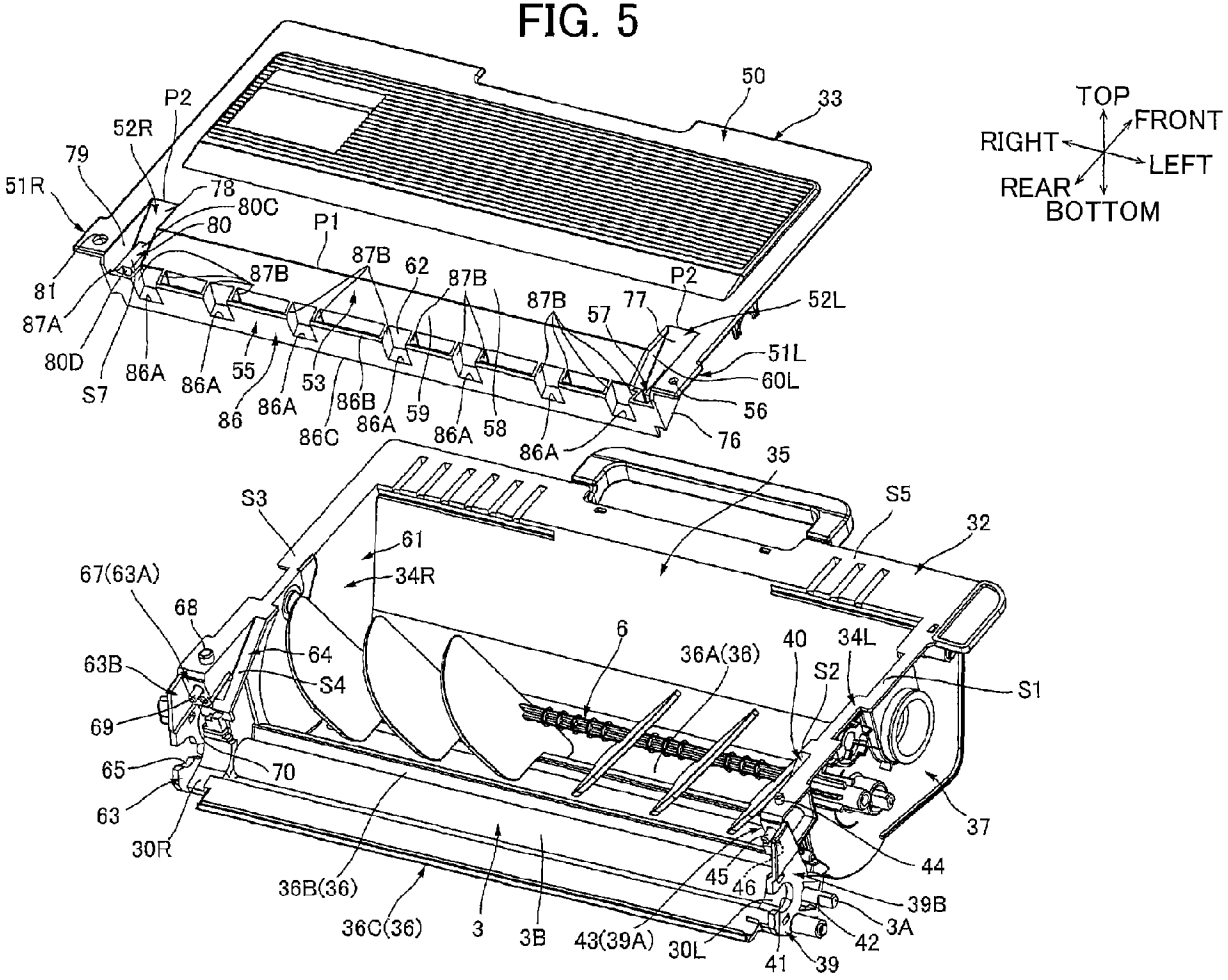
FIG. 5 is an exploded perspective view of the cartridge frame illustrated in FIG. 4 and as viewed from an upper rear side thereof.

As illustrated in FIG. 5, the base frame 32 has a frame-like structure with a closed bottom and an open top. The base frame 32 has a left wall 34L, a right wall 34R, a front wall 35, and a lower wall 36.

Figure 8:
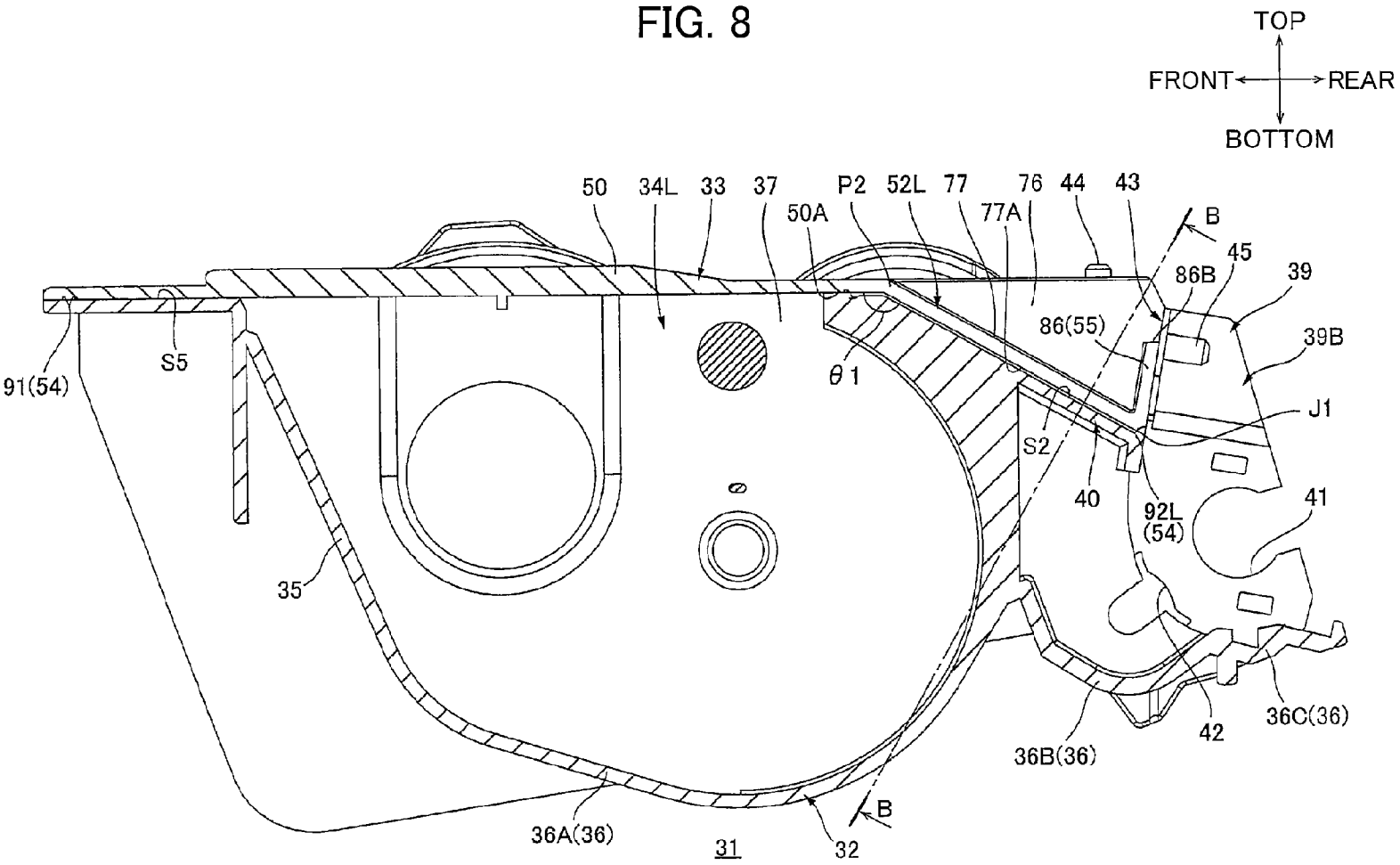
FIG. 8 is a cross-sectional view of the cartridge frame taken along a line A-A in FIG. 4.

As illustrated in FIGS. 5 and 8, the left wall 34L is disposed at a left end of the base frame 32. The left wall 34L includes a main body portion 37 and an attachment portion 39.

The main body portion 37 of the left wall 34L occupies most part of a front portion of the left wall 34L. The main body portion 37 has a general flat plate shape that extends in the front-rear direction. The main body portion 37 has an upper surface S1 that extends in the front-rear direction. The main body portion 37 constitutes a left wall of the toner accommodating portion 5. The main body portion 37 includes an inclined portion 40 and an engagement boss 44.

The inclined portion 40 is disposed at a rear end portion of the main body portion 37. The inclined portion 40 protrudes rightward from a right surface of the main body portion 37 and extends in a direction inclining from the upper front to the lower rear. The inclined portion 40 has an upper surface S2 that is continuous to the upper surface S1 of the main body portion 37. The upper surface S2 extends so as to be inclined downward toward the rear. The upper surface S2 of the inclined portion 40 is positioned closer to the developing roller 2 than part of the upper surface S1 of the main body portion 37 to the developing roller 2, the part of the upper surface S1 being positioned forward of the upper surface S2 with respect to the front-rear direction. The upper surface S2 of the inclined portion 40 forms an obtuse angle with the upper surface S1 of the main body portion 37.

The engagement boss 44 is disposed at the rear end portion of the main body portion 37. The engagement boss 44 protrudes upward from the upper surface S1 of the main body portion 37. The engagement boss 44 has a general columnar shape.

The attachment portion 39 is disposed at a rear end portion of the left wall 34L at a position rearward of the main body portion 37. The attachment portion 39 has a first attachment wall 39A, a second attachment wall 39B, and a first side seal 30L.

The first attachment wall 39A has a general flat plate shape that protrudes leftward from a rear edge of the main body portion 37 and extends in the vertical direction. The first attachment wall 39A includes a blade attachment portion 43.

The blade attachment portion 43 is disposed at an upper end portion of the first attachment wall 39A. The blade attachment portion 43 has a general flat plate shape that extends in the vertical direction. The blade attachment portion 43 has a positioning boss 45 and a screw hole 46.

The positioning boss 45 is disposed at a substantially center portion of the blade attachment portion 43. Further, the positioning boss 45 is positioned downward of the upper surface S1 of the main body portion 37 and also leftward of the inclined portion 40. The positioning boss 45 protrudes rearward from a rear surface of the blade attachment portion 43. The positioning boss 45 has a general columnar shape.

The screw hole 46 is formed in a lower portion of the blade attachment portion 43, separately from the positioning boss 45. The screw hole 46 is recessed forward from the rear surface of the blade attachment portion 43. The screw hole 46 has a general circular shape in a rear view.

The second attachment wall 39B has a general flat plate shape that extends rearward from a left edge of the first attachment wall 39A. The second attachment wall 39B has a developing roller shaft insertion hole 41 and a supply roller shaft insertion hole 42.

The developing roller shaft insertion hole 41 is formed in a rear end portion of the second attachment wall 39B. The developing roller shaft insertion hole 41 penetrates the second attachment wall 39B in the left-right direction and has a circular shape in a side view. The left end portion (see FIG. 1) of the developing roller shaft 2A is inserted into the developing roller shaft insertion hole 41 with an allowance.

The supply roller shaft insertion hole 42 is positioned forward and downward of the developing roller shaft insertion hole 41. The supply roller shaft insertion hole 42 penetrates the second attachment wall 39B in the left-right direction and has a rectangular shape in a side view. The left end portion of the supply roller shaft 3A is inserted into the supply roller shaft insertion hole 42 with an allowance.

The first side seal 30L is positioned below the blade attachment portion 43 and is in contact with the rear surface of the first attachment wall 39A. The first side seal 30L has a general flat plate shape that extends in the vertical direction. The first side seal 30L contacts a peripheral surface of a left end portion (see FIG. 1) of the roller portion 2B of the developing roller 2.

As illustrated in FIG. 5, the right wall 34R is disposed at a right end of the base frame 32. The right wall 34R has a configuration similar to the left wall 34L. Specifically, the right wall 34R includes a main body portion 61 and an attachment portion 63.

The main body portion 61 occupies most part of a front portion of the right wall 34R. The main body portion 61 has a general flat plate shape that extends in the front-rear direction. The main body portion 61 has an upper surface S3 that extends in the front-rear direction. The main body portion 61 constitutes a right wall of the toner accommodating portion 5. The main body portion 61 includes an inclined portion 64 and an engagement boss 68.

The inclined portion 64 is disposed at a rear end portion of the main body portion 61. The inclined portion 64 protrudes leftward from a left surface of the main body portion 61 and extends in the direction inclining from the upper front to the lower rear. The inclined portion 64 has an upper surface S4 that is continuous to the upper surface S3 of the main body portion 61. The upper surface S4 extends so as to be inclined downward toward the rear. The upper surface S4 of the inclined portion 64 is positioned closer to the developing roller 2 than part of the upper surface S3 of the main body portion 37 to the developing roller 2, the part of the upper surface S3 being positioned forward of the upper surface S4 with respect to the front-rear direction. The upper surface S4 of the inclined portion 64 forms an obtuse angel with the upper surface S3 of the main body portion 37.

The engagement boss 68 is disposed at a rear end portion of the main body portion 61. The engagement boss 68 protrudes upward from the upper surface S3 of the main body portion 61. The engagement boss 68 has a general columnar shape. The diameter of the engagement boss 68 is larger than that of the engagement boss 44 of the left wall 34L.

The attachment portion 63 is disposed at a rear end portion of the right wall 34R at a position rearward of the main body portion 61. The attachment portion 63 has a first attachment wall 63A, a second attachment wall 63B, and a first side seal 30R.

The first attachment wall 63A has a general flat plate shape that protrudes rightward from a rear edge of the main body portion 61 and extends in the vertical direction. The first attachment wall 63A includes a blade attachment portion 67.

The blade attachment portion 67 is disposed at an upper end portion of the first attachment wall 63A. The blade attachment portion 67 has a general flat plate shape that extends in the vertical direction. The blade attachment portion 67 has a positioning boss 69 and a screw hole 70.

The positioning boss 69 is disposed at a substantially center portion of the blade attachment portion 67. Further, the positioning boss 69 is positioned downward of the upper surface S3 of the main body portion 61 and also rightward of the inclined portion 64. The positioning boss 69 protrudes rearward from a rear surface of the blade attachment portion 67. The positioning boss 69 has a general columnar shape.

The screw hole 70 is formed in a lower portion of the blade attachment portion 67, separately from the positioning boss 69. The screw hole 70 is recessed forward from the rear surface of the blade attachment portion 67. The screw hole 70 has a general circular shape in a rear view.

The second attachment wall 63B has a general flat plate shape that extends rearward from a right edge of the first attachment wall 63A. The second attachment wall 63B has a developing roller shaft insertion hole 65 and a supply roller shaft insertion hole 66 (see FIG. 7).

The developing roller shaft insertion hole 65 is formed in a rear end portion of the second attachment wall 63B. The developing roller shaft insertion hole 65 penetrates the second attachment wall 63B in the left-right direction and has a circular shape in a side view. The right end portion (see FIG. 1) of the developing roller shaft 2A is inserted into the developing roller shaft insertion hole 65 with an allowance.

The supply roller shaft insertion hole 66 is positioned forward and downward of the developing roller shaft insertion hole 65. The supply roller shaft insertion hole 66 penetrates the second attachment wall 63B in the left-right direction and has a rectangular shape in a side view, similarly to the supply roller shaft insertion hole 42 of the left wall 34L. The right end portion of the supply roller shaft 3A is inserted into the supply roller shaft insertion hole 66 with an allowance.

The first side seal 30R is positioned below the blade attachment portion 67 and is in contact with the rear surface of the first attachment wall 63A. The first side seal 30R has a general flat plate shape that extends in the vertical direction. The first side seal 30R contacts a peripheral surface of a right end portion (see FIG. 1) of the roller portion 2B of the developing roller 2.

As illustrated in FIGS. 3 and 5, the lower wall 36 is disposed at a lower end of the base frame 32. The lower wall 36 includes a first portion 36A, a second portion 36B, and a third portion 36C.

The first portion 36A occupies a front half portion of the lower wall 36. The first portion 36A has a general arcuate shape in a cross-sectional view. The first portion 36A has a substantially front-rear center portion that is recessed downward. The first portion 36A has a left edge that is continuous to a lower end portion of the main body portion 37 of the left wall 34L. The first portion 36A has a right edge that is continuous to a lower end portion of the main body portion 61 of the right wall 34R. The first portion 36A constitutes a bottom wall of the toner accommodating portion 5.

The second portion 36B is positioned rearward of the first portion 36A. The second portion 36B has a general arcuate shape in a cross-sectional view. The second portion 36B is continuous to a rear edge of the first portion 36A and extends rearward so as to be curved along an outer peripheral surface of the roller portion 3B of the supply roller 3. The second portion 36B has a left edge that is continuous to a lower front end portion of the attachment portion 39 of the left wall 34L. The second portion 36B has a right edge that is continuous to a lower front end portion of the attachment portion 63 of the right wall 34R.

The third portion 36C is positioned rearward of the second portion 36B. The third portion 36C has a general linear shape in a cross-sectional view. The third portion 36C is continuous to a rear edge of the second portion 36B and extends rearward. The third portion 36C has a left edge that is continuous to a lower rear end portion of the attachment portion 39 of the left wall 34L. The third portion 36C has a right edge that is continuous to a lower rear end portion of the attachment portion 63 of the right wall 34R.

The front wall 35 is disposed at a front end of the base frame 32. The front wall 35 is continuous to a front edge of the lower wall 36 and extends upward therefrom, with a top end portion of the front wall 35 bending forward and extending forward. The front wall 35 has a left edge that is continuous to a front end portion of the main body portion 37 of the left wall 34L. The front wall 35 has a right edge that is continuous to a front end portion of the main body portion 61 of the right wall 34R. The front wall 35 constitutes a front wall of the toner accommodating portion 5. The front wall 35 has an upper surface S5 that extends in the left-right direction. The upper surface S5 of the front wall 35 is continuous to the upper surface S1 of the main body portion 37 of the left wall 34L and the upper surface S3 of the main body portion 61 of the right wall 34R.

(1-2) Cover Frame

Figure 4:
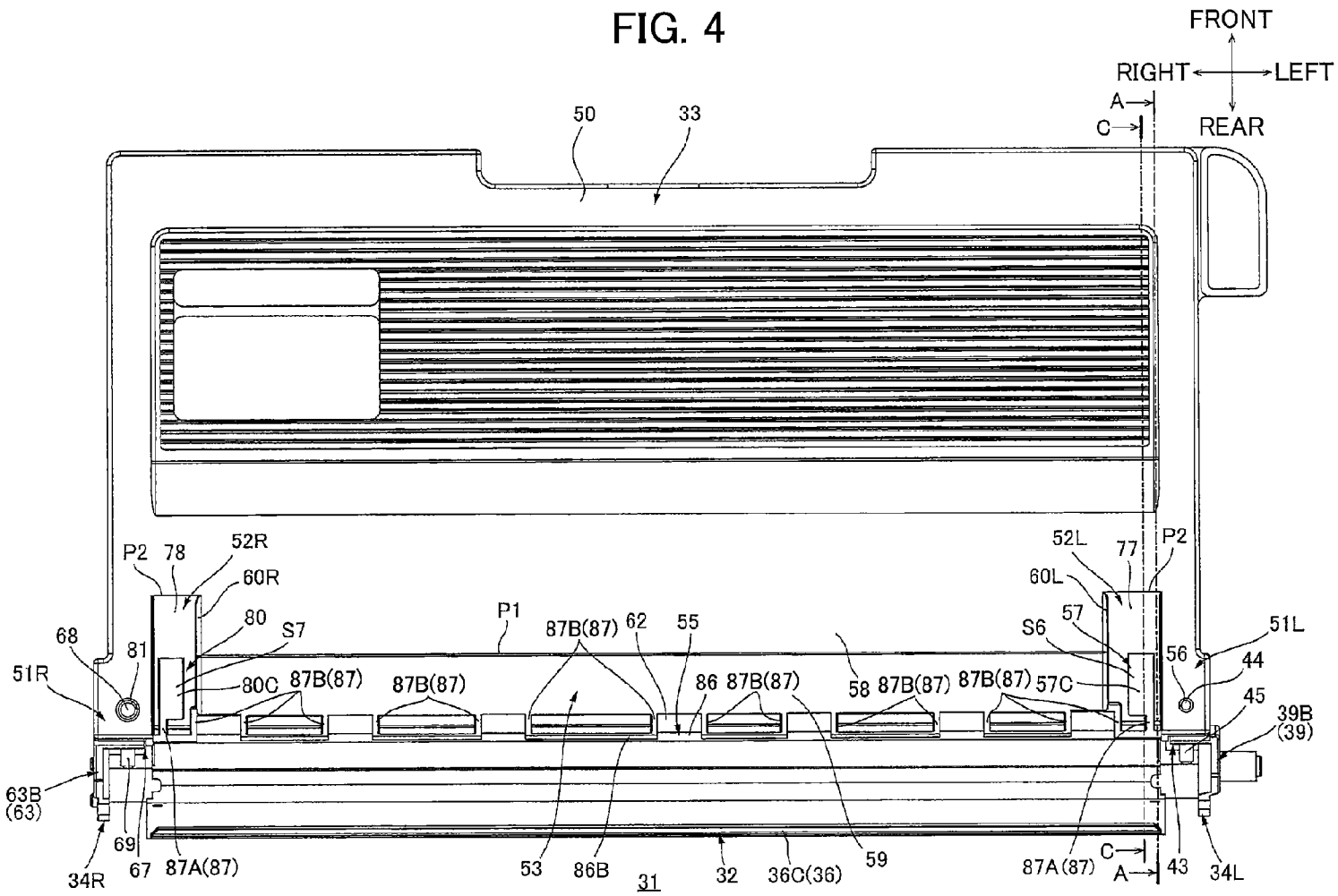
FIG. 4 is a plan view of a cartridge frame of the developing cartridge illustrated in FIG. 1.

As illustrated in FIGS. 4 and 5, the cover frame 33 is positioned above the base frame 32. The cover frame 33 has a flat plate shape that is rectangular in a plan view and extends in the left-right direction. The cover frame 33 includes a main body portion 50, a left engagement portion 51L, a right engagement portion 51R, a left inclined portion 52L, a right inclined portion 52R, a center portion 53, a blade support portion 55, and a melt-bonding rib 54 (see FIG. 6).

The main body portion 50 occupies most part of a front portion of the cover frame 33. The main body portion 50 has a flat plate shape that is generally rectangular in a plan view and extends in the left-right direction. The main body portion 50 has a lower surface 50A. The lower surface 50A extends substantially in parallel to the upper surface S1 of the main body portion 37 and the upper surface S3 of the main body portion 61.

The left engagement portion 51L is disposed at a left rear end portion of the cover frame 33. The left engagement portion 51L has a flat plate shape that is generally rectangular in a plan view. The left engagement portion 51L has an engagement hole 56.

The engagement hole 56 is formed in a center portion of the left engagement portion 51L. The engagement hole 56 penetrates the left engagement portion 51L in the vertical direction and has a general circular shape in a plan view.

The right engagement portion 51R is disposed at a right rear end portion of the cover frame 33. The right engagement portion 51R has a flat plate shape that is generally rectangular in a plan view. The right engagement portion 51R has an engagement hole 81.

The engagement hole 81 is formed in a center portion of the right engagement portion 51R. The engagement hole 81 penetrates the right engagement portion 51R in the vertical direction and has a general circular shape in a plan view.

The left inclined portion 52L is disposed at the left rear end portion of the cover frame 33 at a position rightward of the left engagement portion 51L. The left inclined portion 52L has an inclined wall 77, a vertical wall 76, and a protruding portion 57.

The inclined wall 77 is continuous to the main body portion 50 and extends rearward and downward. That is, the inclined wall 77 is inclined downward toward the rear. The inclined wall 77 has a flat plate shape that is generally rectangular in a plan view. The inclined wall 77 has a lower surface 77A. The lower surface 77A extends substantially in parallel to the upper surface S2 of the inclined portion 40. The lower surface 77A of the inclined wall 77 forms an angle θ1 (see FIG. 8) with the lower surface 50A of the main body portion 50, the angle θ1 being an obtuse angle and 150° in the depicted embodiment. The angle θ1 can be, for example, equal to or larger than 120° and smaller than 180°. Further, the angle θ1 can be, for example, equal to or larger than 130° and equal to or smaller than 170°. Further, the angle θ1 can be, for example, equal to or larger than 140° and equal to or smaller than 160°. Incidentally, the angle formed between the upper surface S1 of the main body portion 37 and the upper surface S2 of the inclined portion 40 is substantially equivalent to the angle θ1.

The vertical wall 76 has a flat plate shape that extends downward from a right edge of the left engagement portion 51L. The vertical wall 76 is continuous to a left edge of the inclined wall 77 at its lower end portion (see FIG. 9).

Figure 9:
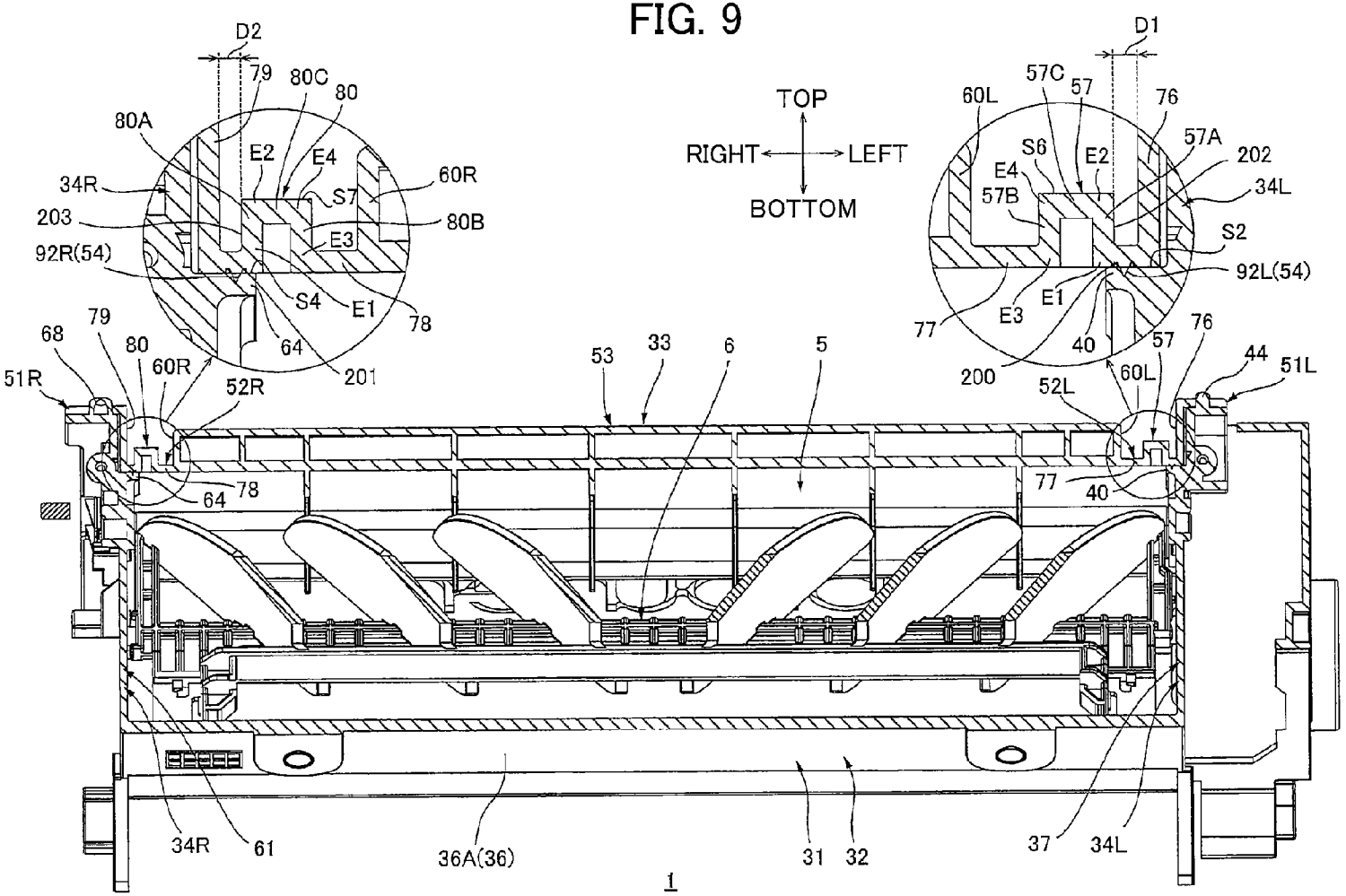
FIG. 9 is a cross-sectional view of the cartridge frame taken along a line B-B in FIG. 8.
Figure 10:
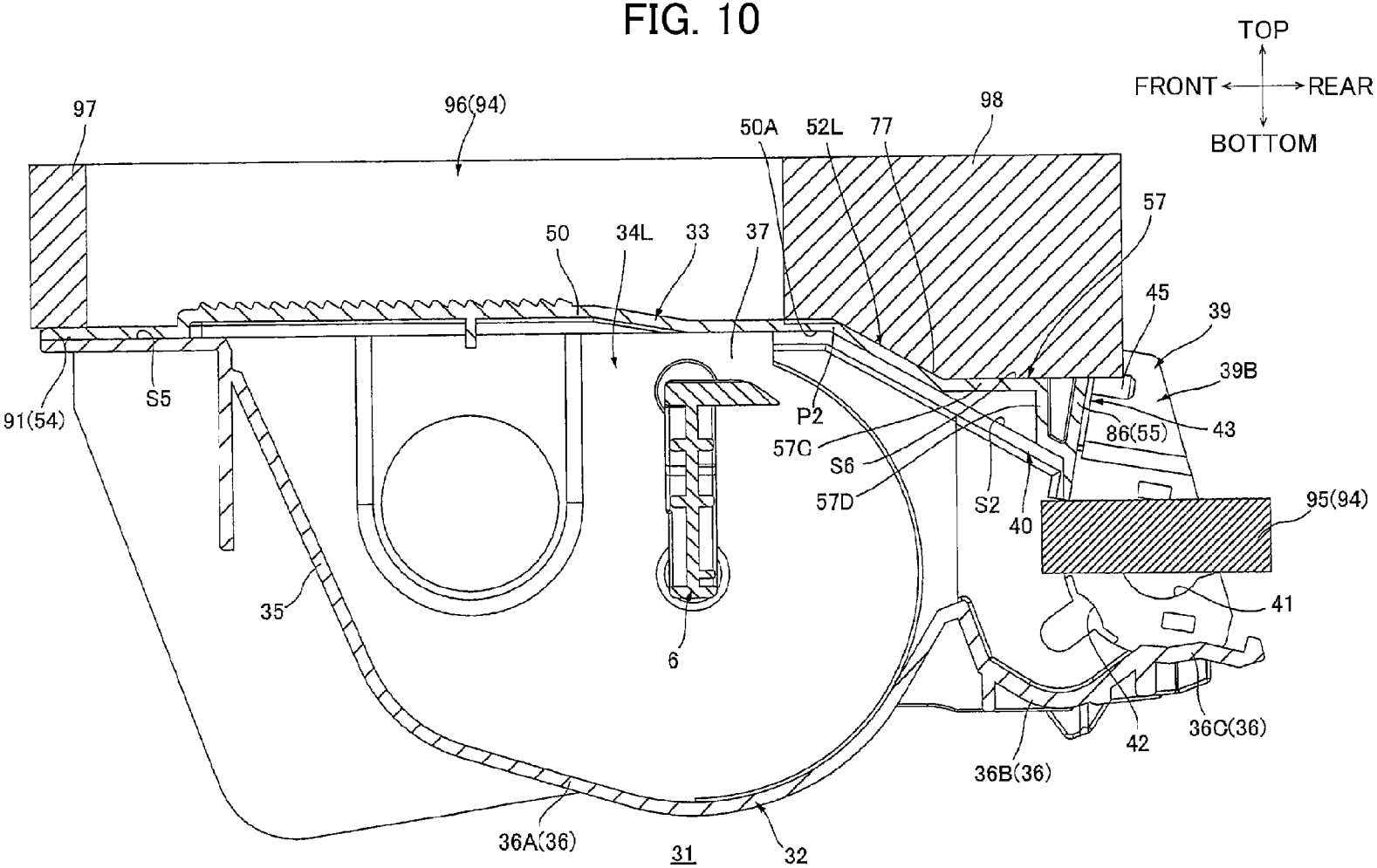
FIG. 10 is a cross-sectional view of the cartridge frame taken along a line C-C in FIG. 4 and showing a state where the developing frame is set in the melt-bonding device.

As illustrated in FIGS. 9 and 10, the protruding portion 57 protrudes upward from a lower half portion of the inclined wall 77. The protruding portion 57 has a general square cylindrical shape whose upper end is closed. In other words, the protruding portion 57 has a predetermined length in the vertical direction and protrudes forward from the lower half portion of the inclined wall 77. The protruding portion 57 is continuous to an upper surface of the inclined wall 77 at its lower end. The lower end of the protruding portion 57 is opened so as to penetrate the inclined wall 77 in the vertical direction between an outer wall 57A and an inner wall 57B to be described later. Specifically, the protruding portion 57 includes the outer wall 57A, the inner wall 57B, an upper wall 57C, and a rear wall 57D.

The outer wall 57A is disposed at a left end of the protruding portion 57. The outer wall 57A is positioned rightward of the vertical wall 76 with a gap D1 therebetween. The outer wall 57A has a flat plate shape that extends upward from the upper surface of the inclined wall 77. That is, the outer wall 57A has a lower edge E1 that is continuous to the inclined wall 77.

The inner wall 57B is disposed at a right end of the protruding portion 57. The inner wall 57B has a flat plate shape that extends upward from the upper surface of the inclined wall 77. That is, the inner wall 57B has a lower edge E3 that is continuous to the inclined wall 77.

The upper wall 57C is disposed at an upper end of the protruding portion 57. The upper wall 57C has a flat plate shape that extends in the front-rear direction. The upper wall 57C has a left edge that is continuous to an upper edge E2 of the outer wall 57A. The upper wall 57C has a right edge that is continuous to an upper edge E4 of the inner wall 57B. The upper wall 57C has a front edge that is continuous to a substantial vertical center portion of the inclined wall 77. The upper wall 57C has an upper surface S6 whose front edge is continuous to the upper surface of the inclined wall 77. Further, the upper surface S6 of the upper wall 57C is parallel to the lower surface 50A of the main body portion 50. The upper surface S6 of the upper wall 57C extends in the front-rear direction from the inclined wall 77 at a position half the vertical height thereof.

The rear wall 57D is disposed at a rear end of the protruding portion 57. The rear wall 57D has a flat plate shape that extends upward from the upper surface of the inclined wall 77. The rear wall 57D has a left edge that is continuous to a rear edge of the outer wall 57A. The rear wall 57D has a right edge that is continuous to a rear edge of the inner wall 57B. The rear wall 57D has an upper edge that is continuous to a rear edge of the upper wall 57C.

As illustrated in FIG. 5, the right inclined portion 52R is disposed at the rear right end portion of the cover frame 33 at a position leftward of the right engagement portion 51R. The right inclined portion 52R has an inclined wall 78, a vertical wall 79, and a protruding portion 80.

The inclined wall 78 is continuous to the main body portion 50 and extends rearward and downward. That is, the inclined wall 78 is inclined downward toward the rear. The inclined wall 78 has a flat plate shape that is generally rectangular in a plan view. The inclined wall 78 has a lower surface 78A (see FIG. 6). The lower surface 78A extends substantially in parallel to the upper surface S4 of the inclined portion 64. The lower surface 78A of the inclined wall 78 forms an angle with the lower surface 50A of the main body portion 50, the angle being equal to the angle θ1 formed between the lower surface 77A of the inclined wall 77 and the lower surface 50A of the main body portion 50. Incidentally, the angle formed between the upper surface S3 of the main body portion 61 and the upper surface S4 of the inclined portion 64 is substantially equivalent to the angle θ1.

The vertical wall 79 has a flat plate shape that extends downward from a left edge of the right engagement portion 51R. The vertical wall 79 is continuous to a right edge of the inclined wall 78 at its lower end portion (see FIG. 9).

As illustrated in FIGS. 5 and 9, the protruding portion 80 protrudes upward from a lower half portion of the inclined wall 78. The protruding portion 80 has a general square cylindrical shape whose upper end is closed. The protruding portion 80 is continuous to an upper surface of the inclined wall 78 at its lower end. The lower end of the protruding portion 80 is opened so as to penetrate the inclined wall 78 in the vertical direction between an outer wall 80A and an inner wall 80B to be described later. Specifically, the protruding portion 80 includes the outer wall 80A, the inner wall 80B, an upper wall 80C, and a rear wall 80D (see FIG. 5).

The outer wall 80A is disposed at a right end of the protruding portion 80. The outer wall 80A is positioned leftward of the vertical wall 79 with a gap D2 therebetween. The outer wall 80A has a flat plate shape that extends upward from the upper surface of the inclined wall 78. That is, the outer wall 80A has a lower edge E1 that is continuous to the inclined wall 78.

The inner wall 80B is disposed at a left end of the protruding portion 80. The inner wall 80B has a flat plate shape that extends upward from the upper surface of the inclined wall 78. That is, the inner wall 80B has a lower edge E3 that is continuous to the inclined wall 78.

The upper wall 80C is disposed at an upper end of the protruding portion 80. The upper wall 80C has a flat plate shape that extends in the front-rear direction. The upper wall 80C has a right edge that is continuous to an upper edge E2 of the outer wall 80A. The upper wall 80C has a left edge that is continuous to an upper edge E4 of the inner wall 80B. The upper wall 80C has a front edge that is continuous to a substantial vertical center portion of the inclined wall 78. The upper wall 80C has an upper surface S7 whose front edge is continuous to the upper surface of the inclined wall 78. Further, the upper surface S7 of the upper wall 80C is parallel to the lower surface 50A of the main body portion 50. The upper surface S7 of the upper wall 80C extends in the front-rear direction from the inclined wall 78 at a position half the vertical height thereof.

The rear wall 80D is disposed at a rear end of the protruding portion 80. The rear wall 80D has a flat plate shape that extends upward from the upper surface of the inclined wall 78. The rear wall 80D has a right edge that is continuous to a rear edge of the outer wall 80A. The rear wall 80D has a left edge that is continuous to a rear edge of the inner wall 80B. The rear wall 80D has an upper edge that is continuous to a rear edge of the upper wall 80C.

As illustrated in FIGS. 3 and 5, the center portion 53 is disposed between the left inclined portion 52L and the right inclined portion 52R. That is, the engagement boss 44 is positioned separated leftward from the center portion 53 further than the left inclined portion 52L from the center portion 53. Further, the engagement boss 68 is positioned separated rightward from the center portion 53 further than the right inclined portion 52R from the center portion 53. The center portion 53 has a general square cylindrical shape with closed left and right ends and an open bottom, and extends in the left-right direction. Specifically, the center portion 53 has a parallel wall 58, an inclined wall 59, a left wall 60L, a right wall 60R (see FIG. 9), and a rear wall 62.

The parallel wall 58 is continuous to the main body portion 50 and extends rearward. The parallel wall 58 has a flat plate shape that is generally rectangular in a plan view and extends in the front-rear direction.

The inclined wall 59 is continuous to the parallel wall 58 and extends rearward and downward. The inclined wall 59 is inclined downward toward the rear. That is, the inclined wall 59 is positioned closer to the developing roller 2 than the parallel wall 58 to the developing roller 2. The inclined wall 59 has a flat plate shape that is generally rectangular in a plan view. A lower surface 59A of the inclined wall 59 forms an angle θ2 (see FIG. 3) with a lower surface 58A of the parallel wall 58, the angle θ2 being an obtuse angle larger than the angle θ1 (see FIG. 8) formed between the lower surface 77A of the inclined wall 77 and the lower surface 50A of the main body portion 50. The angle θ2 is 156° in the depicted embodiment. The angle θ2 can be, for example, equal to or larger than 120° and smaller than 180°. Further, the angle θ2 can be, for example, equal to or larger than 130° and equal to or smaller than 170°. Further, the angle θ2 can be, for example, equal to or larger than 140° and equal to or smaller than 160°. Further, the lower surface 59A of the inclined wall 59 is positioned rearward and upward of the lower surface 77A (see FIG. 8) of the inclined wall 77. Further, a continuous portion P1 (see FIGS. 3 and 5) between the inclined wall 59 and the parallel wall 58 is positioned rearward of a continuous portion P2 (see FIGS. 5 and 8) between the inclined wall 77 and the main body portion 50. The continuous portion P1 is positioned closer to the developing roller 2 than the continuous portion P2 to the developing roller 2.

As illustrated in FIGS. 5 and 9, the left wall 60L is disposed at a left end of the center portion 53. The left wall 60L has a flat plate shape that extends in the vertical direction. The left wall 60L has an upper edge that is continuous to a left edge of the parallel wall 58 and a left edge of the inclined wall 59. The left wall 60L has a lower edge that is continuous to a right edge of the inclined wall 77 of the left inclined portion 52L.

As illustrated in FIG. 9, the right wall 60R is disposed at a right end of the center portion 53. The right wall 60R has a flat plate shape that extends in the vertical direction. The right wall 60R has an upper edge that is continuous to a right edge of the parallel wall 58 and a right edge of the inclined wall 59. The right wall 60R has a lower edge that is continuous to a left edge of the inclined wall 78 of the right inclined portion 52R.

As illustrated in FIGS. 3 and 5, the rear wall 62 is disposed at a rear end of the center portion 53. The rear wall 62 has a flat plate shape that extends in the vertical direction. The rear wall 62 has an upper edge that is continuous to a rear edge of the inclined wall 59. The rear wall 62 has a left edge that is continuous to a rear edge of the left wall 60L. The rear wall 62 has a right edge that is continuous to a rear edge of the right wall 60R.

As illustrated in FIG. 5, the blade support portion 55 is positioned rearward of the center portion 53 and between a rear end portion of the vertical wall 76 of the left inclined portion 52L and a rear end portion of the vertical wall 79 of the right inclined portion 52R. The blade support portion 55 has an opposing wall 86 and a plurality of connection ribs 87.

The opposing wall 86 has a flat plate shape that is rectangular in a rear view and extends in the left-right direction. The opposing wall 86 has a left edge that is continuous to a rear edge of the vertical wall 76 of the left inclined portion 52L. Further, a lower end portion (see FIG. 8) at a left end portion of the opposing wall 86 is continuous to a rear edge of the inclined wall 77 of the left inclined portion 52L. The opposing wall 86 has a right edge that is continuous to a rear edge of the vertical wall 79 of the right inclined portion 52R. Further, similar to the left end portion of the opposing wall 86, a lower end portion at a right end portion of the opposing wall 86 is continuous to a rear edge of the inclined wall 78 of the right inclined portion 52R. The opposing wall 86 includes a plurality of concave portions 86A. Further, the opposing wall 86 has an upper edge 86B and a lower edge 86C.

The plurality of concave portions 86A is disposed between the left inclined portion 52L and the right inclined portion 52R, spaced away from each other in the left-right direction. Each of the plurality of concave portions 86A has a general U-shape in a rear view that is recessed downward from the upper edge 86B of the opposing wall 86 and has an opening at its upper end.

As illustrated in FIGS. 4 and 5, the plurality of connection ribs 87 includes first connection ribs 87A and second connection ribs 87B.

The first connection ribs 87A include a left first connection rib 87A and a right first connection rib 87A. The left first connection rib 87A has a general flat plate shape that extends rearward from a left end portion of the protruding portion 57 of the left inclined portion 52L. The left first connection rib 87A has a rear end that is continuous to a front surface of the left end portion of the opposing wall 86. The right first connection rib 87A has a general flat plate shape that extends rearward from a right end portion of the protruding portion 80 of the right inclined portion 52R. The right first connection rib 87A has a rear end that is continuous to a front surface of the right end portion of the opposing wall 86.

The second connection ribs 87B connect the center portion 53 and the opposing wall 86. The second connection ribs 87B each have a general flat plate shape that extends rearward from the rear wall 62 of the center portion 53. Each of the second connection ribs 87B is continuous to an edge defining the concave portion 86A at its rear end.

Figure 6:
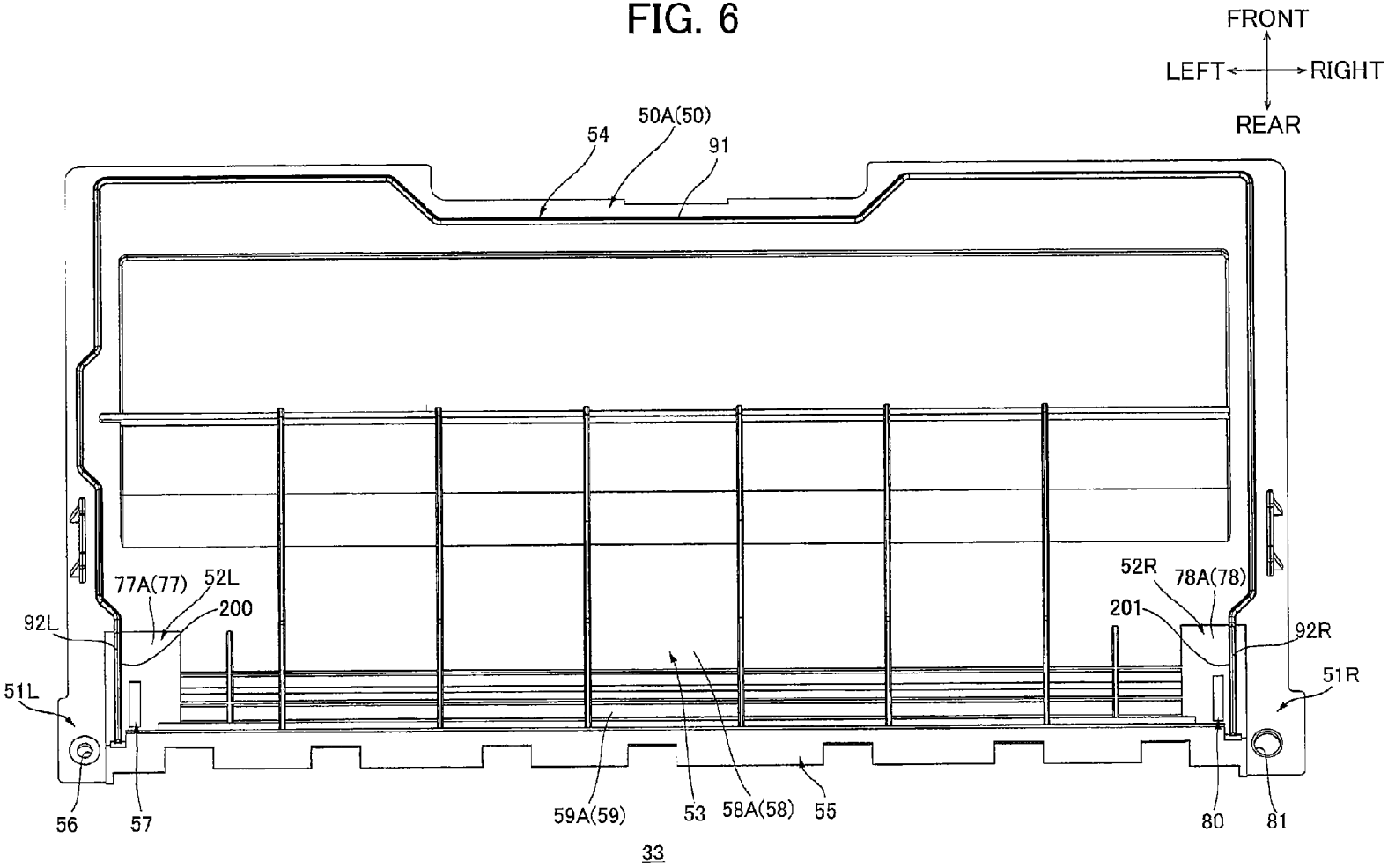
FIG. 6 is a bottom view of a cover frame of the cartridge frame illustrated in FIG. 5.

As illustrated in FIG. 6, the melt-bonding rib 54 includes a first melt-bonding rib 91, a left second melt-bonding rib 92L, and a right second melt-bonding rib 92R.

The first melt-bonding rib 91 is disposed at an outer periphery of the main body portion 50. The first melt-bonding rib 91 protrudes downward from the lower surface 50A of the main body portion 50 and extends along the outer periphery of the main body portion 50. A rear end at a left portion of the first melt-bonding rib 91 is positioned forward of a left end portion of the left inclined portion 52L. A rear end at a right portion of the first melt-bonding rib 91 is positioned forward of a right end portion of the right inclined portion 52R.

As illustrated in FIG. 6, the left second melt-bonding rib 92L is disposed at a lower surface of the left inclined portion 52L. The left second melt-bonding rib 92L protrudes downward from the lower surface of the left inclined portion 52L at the left end portion thereof and extends in the front-rear direction. The left second melt-bonding rib 92L has a front end that is continuous to the rear end of the left portion of the first melt-bonding rib 91. The left second melt-bonding rib 92L has a rear end that is disposed at a rear end of the inclined wall 77 of the left inclined portion 52L. As illustrated in FIG. 9, a right edge 200 of the left second melt-bonding rib 92L is positioned below the outer wall 57A of the protruding portion 57 of the left inclined portion 52L. Specifically, the right edge 200 of the left second melt-bonding rib 92L overlaps the outer wall 57A as viewed in the vertical direction so as to extend along a left surface 202 of the outer wall 57A.

As illustrated in FIG. 6, the right second melt-bonding rib 92R is disposed at a lower surface of the right inclined portion 52R. The right second melt-bonding rib 92R protrudes downward from the lower surface of the right inclined portion 52R at the right end portion thereof and extends in the front-rear direction. The right second melt-bonding rib 92R has a front end that is continuous to the rear end of the right portion of the first melt-bonding rib 91. The right second melt-bonding rib 92R has a rear end that is disposed at a rear end of the inclined wall 78 of the right inclined portion 52R. As illustrated in FIG. 9, a left edge 201 of the right second melt-bonding rib 92R is positioned below the outer wall 80A of the protruding portion 80 of the right inclined portion 52R. Specifically, the left edge 201 of the right second melt-bonding rib 92R overlaps the outer wall 80A as viewed in the vertical direction so as to extend along a right surface 203 of the outer wall 80A.

(2) Blade

Figure 11A:
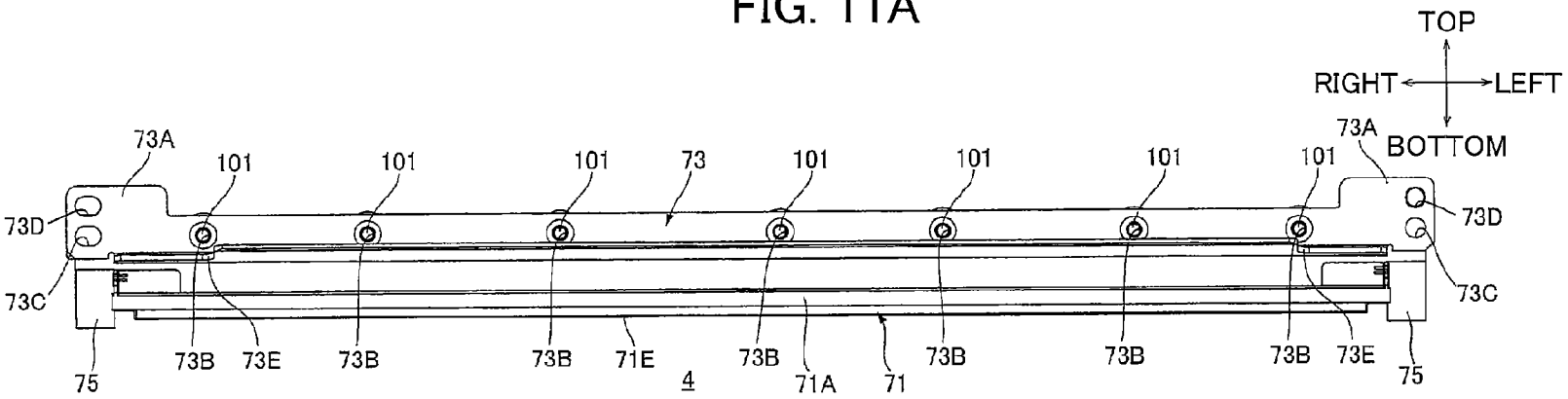
FIG. 11A is a rear view of a blade of the developing cartridge illustrated in FIG. 1.
Figure 11B:
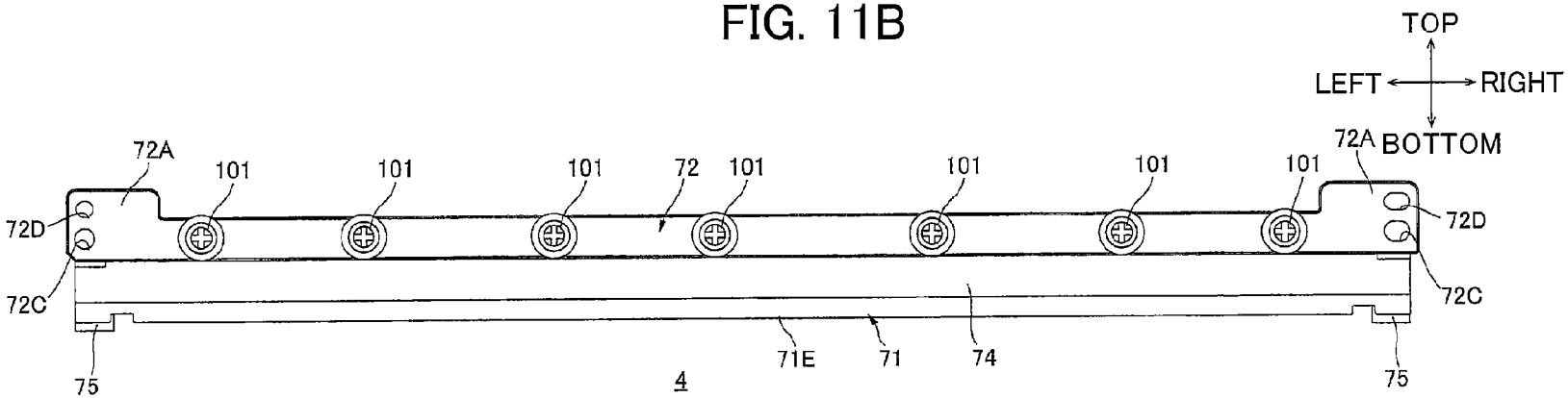
FIG. 11B is a front view of the blade illustrated in FIG. 11A.
Figure 12:
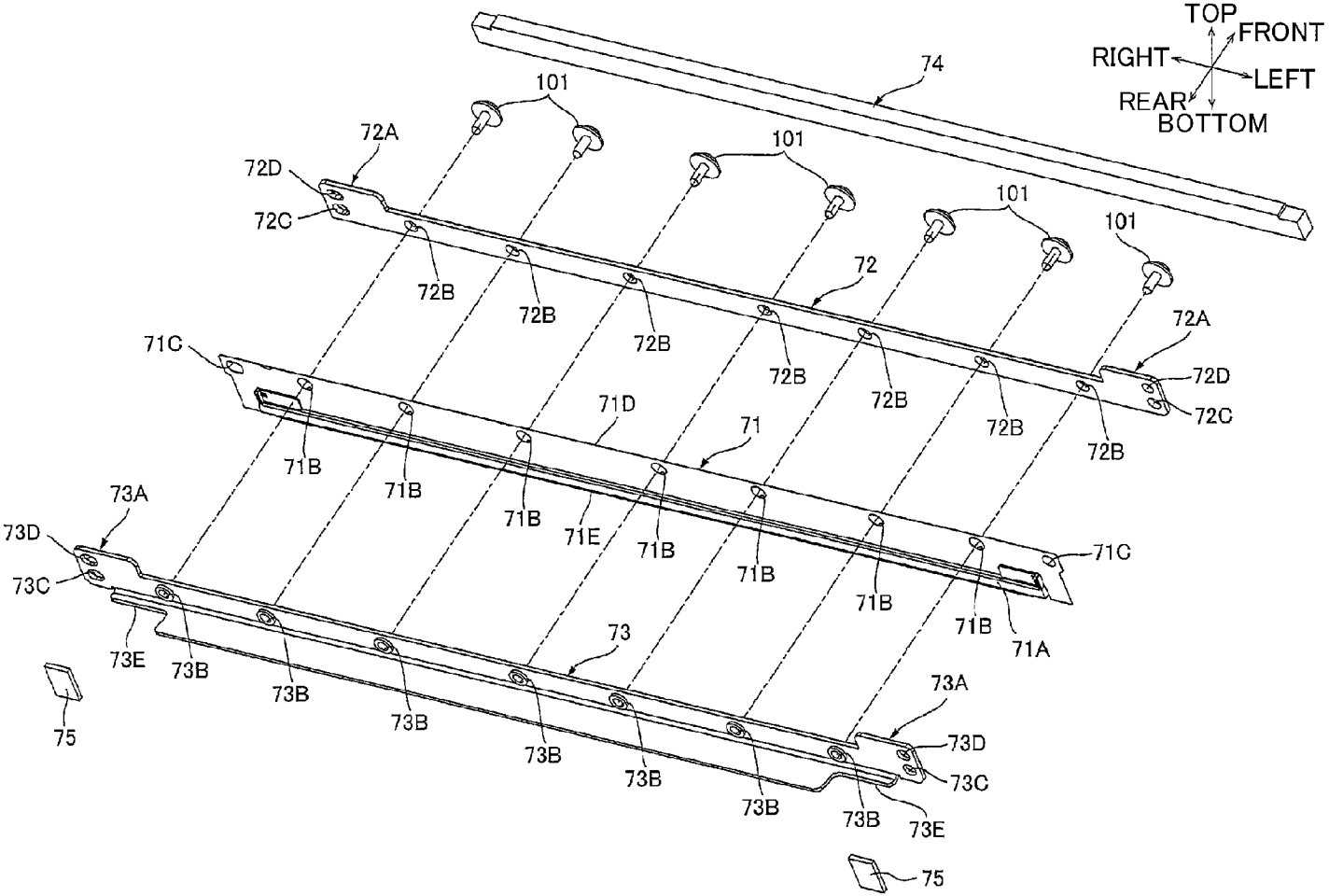
FIG. 12 is an exploded perspective view of the blade illustrated in FIG. 11A as viewed from an upper rear side thereof.

As illustrated in FIGS. 11A, 11B and 12, the blade 4 includes a blade body 71, a first support plate 72, a second support plate 73, a blade seal 74, two second side seals 75, and a plurality of screws 101.

The blade body 71 is made from metal and has a flat plate shape that extends in the left-right direction. The blade body 71 has a contact member 71A, a plurality of first screw insertion holes 71B, and two second screw insertion holes 71C. Further, the blade body 71 has an upper edge 71D and a lower edge 71E.

The contact member 71A is disposed at a rear surface of a lower end portion of the blade body 71. The contact member 71A is made from silicone rubber and has a general flat plate shape that extends in the left-right direction.

The plurality of first screw insertion holes 71B is formed at an upper end portion of the blade body 71. The plurality of first screw insertion holes 71B is arranged spaced away from each other in the left-right direction. Each of the plurality of first screw insertion holes 71B penetrates the blade body 71 in the front-rear direction and has a general circular shape.

One of the two second screw insertion holes 71C is formed in an upper left end portion of the blade body 71, while the other of the two second screw insertion holes 71C is formed in an upper right end portion of the blade body 71. The left second screw insertion hole 71C penetrates the blade body 71 in the front-rear direction and has a general circular shape. The right second screw insertion hole 71C penetrates the blade body 71 in the front-rear direction and is a general elongated hole that is elongated in the left-right direction.

The first support plate 72 is positioned forward of the upper end portion of the blade body 71. The first support plate 72 is made from metal having a thickness greater than that of the blade body 71. The first support plate 72 has a flat plate shape that extends in the left-right direction. The first support plate 72 has two projecting portions 72A, a plurality of first screw insertion holes 72B, two second screw insertion holes 72C, and two positioning boss insertion holes 72D.

One of the two projecting portions 72A is disposed at an upper left end portion of the first support plate 72, while the other of the two projecting portions 72A is disposed at an upper right end portion of the first support plate 72. The left projecting portion 72A protrudes upward from the upper left end portion of the first support plate 72 and has a general rectangular flat plate shape. The right projecting portion 72A protrudes upward from the upper right end portion of the first support plate 72 and has a general rectangular flat plate shape.

The plurality of first screw insertion holes 72B is formed in an upper end portion of the first support plate 72. The plurality of first screw insertion holes 72B is arranged spaced away from each other in the left-right direction. Each of the plurality of first screw insertion holes 72B penetrates the first support plate 72 in the front-rear direction and has a general circular shape.

One of the two second screw insertion holes 72C is formed in a lower left end portion of the first support plate 72, while the other of the two second screw insertion holes 72C is formed in a lower right end portion of the first support plate 72. The left second screw insertion hole 72C penetrates the first support plate 72 in the front-rear direction and has a general circular shape. The right second screw insertion hole 72C penetrates the first support plate 72 in the front-rear direction and is a general elongated hole that is elongated in the left-right direction.

One of the two positioning boss insertion holes 72D is formed in the upper left end portion of the first support plate 72, while the other of the two positioning boss insertion holes 72D is formed in the upper right end portion of the first support plate 72. The left positioning boss insertion hole 72D penetrates the left projecting portion 72A in the front-rear direction and has a general circular shape. The right positioning boss insertion hole 72D penetrates the right projecting portion 72A in the front-rear direction and is a general elongated hole that is elongated in the left-right direction.

The second support plate 73 is positioned rearward of the upper end portion of the blade body 71. The second support plate 73 is made from metal having a thickness greater than that of the blade body 71. The second support plate 73 has a flat plate shape that extends in the left-right direction and whose lower end portion is bent rearward. The second support plate 73 has two projecting portions 73A, a plurality of screw fixed holes 73B, two screw insertion holes 73C, two positioning boss insertion holes 73D, and two notch portions 73E.

One of the two projecting portions 73A is disposed at an upper left end portion of the second support plate 73, while the other of the two projecting portions 73A is disposed at an upper right end portion of the second support plate 73. The left projecting portion 73A protrudes upward from the upper left end portion of the second support plate 73 and has a general rectangular flat plate shape. The right projecting portion 73A protrudes upward from the upper right end portion of the second support plate 73 and has a general rectangular flat plate shape.

The plurality of screw fixed holes 73B is formed in an upper end portion of the second support plate 73. The plurality of screw fixed holes 73B is arranged spaced away from each other in the left-right direction. Each of the plurality of screw fixed holes 73B penetrates the second support plate 73 in the front-rear direction and has a general circular shape.

One of the two screw insertion holes 73C is formed in a lower left end portion of the second support plate 73, while the other of the two screw insertion holes 73C is formed in a lower right end portion of the second support plate 73. The left screw insertion hole 73C penetrates the second support plate 73 in the front-rear direction and has a general circular shape. The right screw insertion hole 73C penetrates the second support plate 73 in the front-rear direction and is a general elongated hole that is elongated in the left-right direction.

One of the two positioning boss insertion holes 73D is formed in the upper left end portion of the second support plate 73, while the other of the two positioning boss insertion holes 73D is formed in the upper right end portion of the second support plate 73. The left positioning boss insertion hole 73D penetrates the left projecting portion 73A in the front-rear direction and has a general circular shape. The right positioning boss insertion hole 73D penetrates the right projecting portion 73A in the front-rear direction and is a general elongated hole that is elongated in the left-right direction.

One of the two notch portions 73E is formed in the lower left end portion of the second support plate 73, while the other of the two notch portions 73E is formed in the lower right end portion of the second support plate 73. Each of the two notch portions 73E is notched forward from a rear edge of the second support plate 73. Each of the two notch portions 73E has a general rectangular shape. When a maintenance operation for the developing cartridge 1 (see FIG. 1) is performed, for example, a cleaning tool such as a brush is inserted below the second support plate 73 through the notch portion 73E to clean a contact portion between the roller portion 2B of the developing roller 2 and the blade body 71 of the blade 4.

The blade seal 74 is disposed at a front surface of the lower end portion of the blade body 71. The blade seal 74 has a general square columnar shape that extends in the left-right direction. The blade seal 74 is fixed to the front surface of the lower end portion of the blade body 71 by means of adhesion, for example.

The two second side seals 75 are positioned outside the contact member 71A in the left-right direction, one of the two second side seals 75 being disposed at a rear surface of a lower left end portion of the blade body 71 and the other of the two second side seals 75 being disposed at a rear surface of a lower right end portion of the blade body 71. Each of the two second side seals 75 has a general rectangular flat plate shape. The left second side seal 75 is fixed to the rear surface of the lower left end portion of the blade body 71 by means of adhesion, for example. The right second side seal 75 is fixed to the rear surface of the lower right end portion of the blade body 71 by means of adhesion, for example.

The plurality of screws 101 is respectively inserted into the first screw insertion holes 72B of the first support plate 72 and the first screw insertion holes 71B of the blade body 71, and fixed to the screw fixed hole 73B of the second support plate 73. In this way, the upper end portion of the blade body 71 is fixedly sandwiched between the first support plate 72 and the second support plate 73.

4. Assembly of Developing Cartridge (1) Configuration of Melt-Bonding Device

Figure 7:
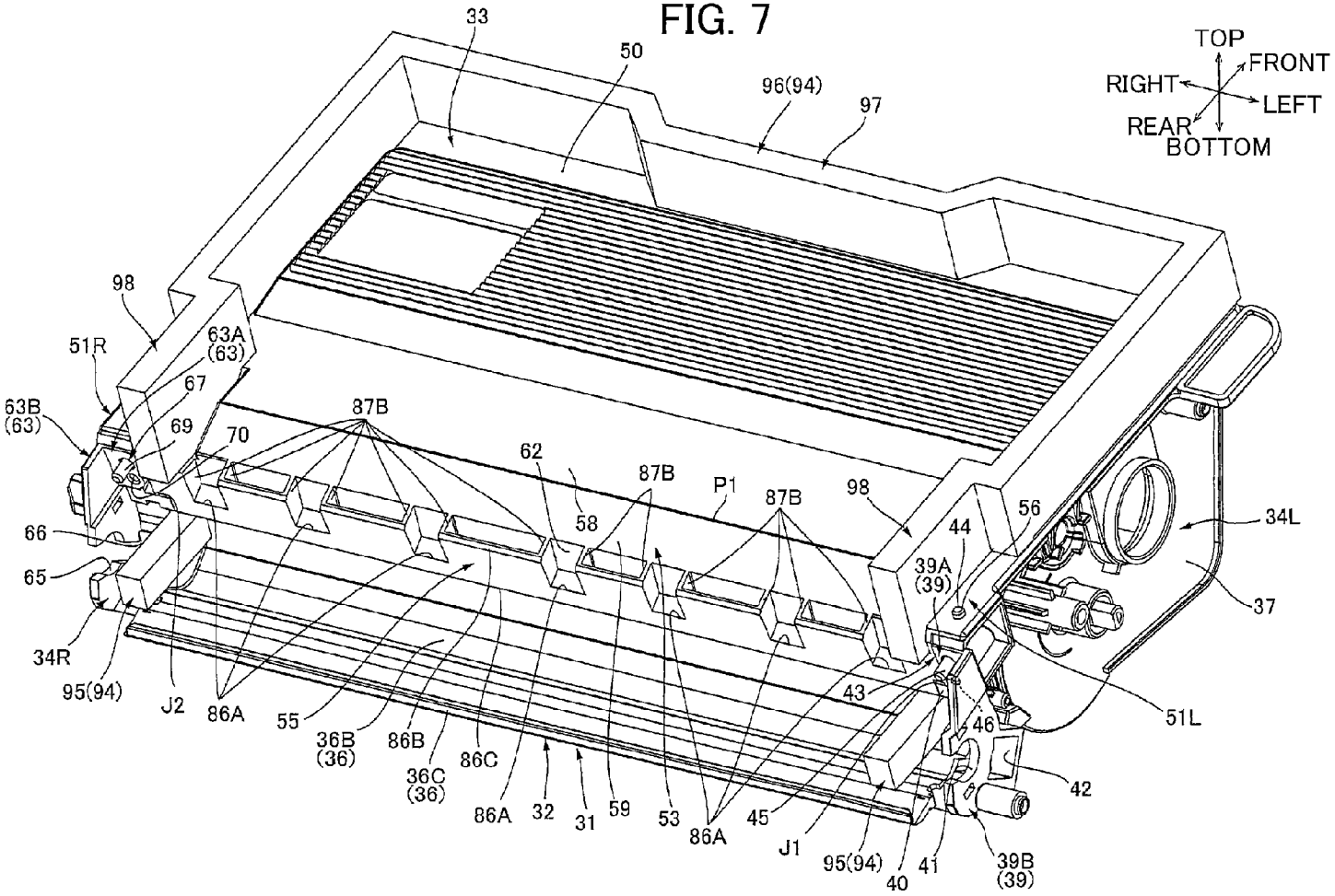
FIG. 7 is a perspective view of the cartridge frame illustrated in FIG. 4 and showing a state where the cartridge frame is set in a melt-bonding device.

As illustrated in FIG. 7, a melt-bonding (or welding) device 94 is used for the assembly of the developing cartridge 1. The melt-bonding device 94 includes two jigs 95 and a vibration portion 96.

The two jigs 95 are arranged spaced away from each other in the left-right direction. Each of the two jigs 95 has a general square columnar shape that extends in the front-rear direction.

As illustrated in FIGS. 7 and 10, the vibration portion 96 has a general rectangular frame-like shape with an opening at its rear end. The vibration portion 96 includes a first vibration portion 97 and two second vibration portions 98.

The first vibration portion 97 has a shape in conformance with the outer periphery of the main body portion 50 of the cover frame 33. Specifically, the first vibration portion 97 has a general rectangular frame-like shape with an opening at its rear end.

The second vibration portions 98 include a left second vibration portion 98 and a right second vibration portion 98. The left second vibration portion 98 has a shape in conformance with the left inclined portion 52L of the cover frame 33. Specifically, the left second vibration portion 98 has a general trapezoidal shape in a side view and extends rearward from a left rear end portion of the first vibration portion 97. The right second vibration portion 98 has a shape in conformance with the right inclined portion 52R of the cover frame 33. Specifically, the right second vibration portion 98 has a general trapezoidal shape in a side view and extends rearward from a right rear end portion of the first vibration portion 97.

(2) Melt-Boding of Cover Frame to Base Frame

In order to assemble the developing cartridge 1, an operator first assembles the agitator 6 to the base frame 32, and then, places the cover frame 33 onto the base frame 32 so as to cover the base frame 32, as illustrated in FIGS. 7 and 10. In this state, the cover frame 33 is melt-bonded (or welded) to the base frame 32.

In a state where the cover frame 33 is placed onto the base frame 32, the first melt-bonding rib 91 of the cover frame 33 contacts, from above, the upper surface S1 of the main body portion 37 of the left wall 34L of the base frame 32, the upper surface S3 of the main body portion 61 of the right wall 34R of the base frame 32, and the upper surface S5 of the front wall 35 of the base frame 32, as illustrated in FIGS. 5 and 8.

Further, the left second melt-bonding rib 92L of the cover frame 33 contacts, from above, the upper surface S2 of the inclined portion 40 of the left wall 34L of the base frame 32, as illustrated in FIGS. 8 and 9. Further, the right second melt-bonding rib 92R of the cover frame 33 contacts, from above, the upper surface S4 of the inclined portion 64 of the right wall 34R of the base frame 32.

At this time, the outer wall 57A of the protruding portion 57 of the left inclined portion 52L of the cover frame 33 is positioned above a right edge of the inclined portion 40 of the left wall 34L of the base frame 32. Further, the inner wall 57B of the protruding portion 57 is positioned rightward of the right edge of the inclined portion 40. With this arrangement, the internal space of the protruding portion 57 is in communication with the internal space of the developing frame 31, that is, the toner accommodating portion 5.

Further, the outer wall 80A of the protruding portion 80 of the right inclined portion 52R of the cover frame 33 is positioned above a left edge of the inclined portion 64 of the right wall 34R of the base frame 32. Further, the inner wall 80B of the protruding portion 80 is positioned leftward of the left edge of the inclined portion 64. With this arrangement, the internal space of the protruding portion 80 is in communication with the internal space of the developing frame 31, that is, the toner accommodating portion 5.

Further, the engagement boss 44 of the left wall 34L is inserted into the engagement hole 56 of the left engagement portion 51L. The engagement boss 68 of the right wall 34R is inserted into the engagement hole 81 of the right engagement portion 51R. In other words, the engagement hole 56 is positioned separated leftward from the center portion 53 further than the inclined portion 40 from the center portion 53. Further, the engagement hole 81 is positioned separated rightward from the center portion 53 further than the inclined portion 64 from the center portion 53.

Next, the operator sets the developing frame 31 in the melt-bonding device 94 as illustrated in FIG. 7.

At this time, the left jig 95 contacts the rear end portion of the inclined portion 40 of the left wall 34L from below. Further, the right jig 95 contacts the rear end portion of the inclined portion 64 of the right wall 34R from below.

Further, the first vibration portion 97 contacts the upper surface of the main body portion 50 of the cover frame 33 so as to be positioned above the first melt-bonding rib 91. Further, the left second vibration portion 98 contacts the upper surface of the inclined wall 77 of the cover frame 33 and the upper surface of the protruding portion 57 (i.e. upper surface S6) of the cover frame 33 so as to be positioned above the left second melt-bonding rib 92L. Further, the right second vibration portion 98 contacts the upper surface of the inclined wall 78 of the cover frame 33 and the upper surface of the protruding portion 80 (i.e. upper surface S7) of the cover frame 33 so as to be positioned above the right second melt-bonding rib 92R.

Then, when the melt-bonding device 94 is operated, the first vibration portion 97 and the second vibration portions 98 generate an ultrasonic wave. The first melt-bonding rib 91 is melted by the ultrasonic wave generated from the first vibration portion 97, and thus, the main body portion 50 of the cover frame 33 is bonded to the left wall 34L, the right wall 34R, and the front wall 35 of the base frame 32. Further, the left second melt-bonding rib 92L is melted by the ultrasonic wave generated from the left second vibration portion 98, and thus, the left inclined portion 52L of the cover frame 33 is bonded to the inclined portion 40 of the left wall 34L of the base frame 32. Further, the right second melt-bonding rib 92R is melted by the ultrasonic wave generated from the right second vibration portion 98, and thus, the right inclined portion 52R of the cover frame 33 is bonded to the inclined portion 64 of the right wall 34R of the base frame 32.

In this way, the cover frame 33 is melt-bonded to the base frame 32. The developing frame 31 is thus completed.

(2) Assembly of Blade

Figure 13:
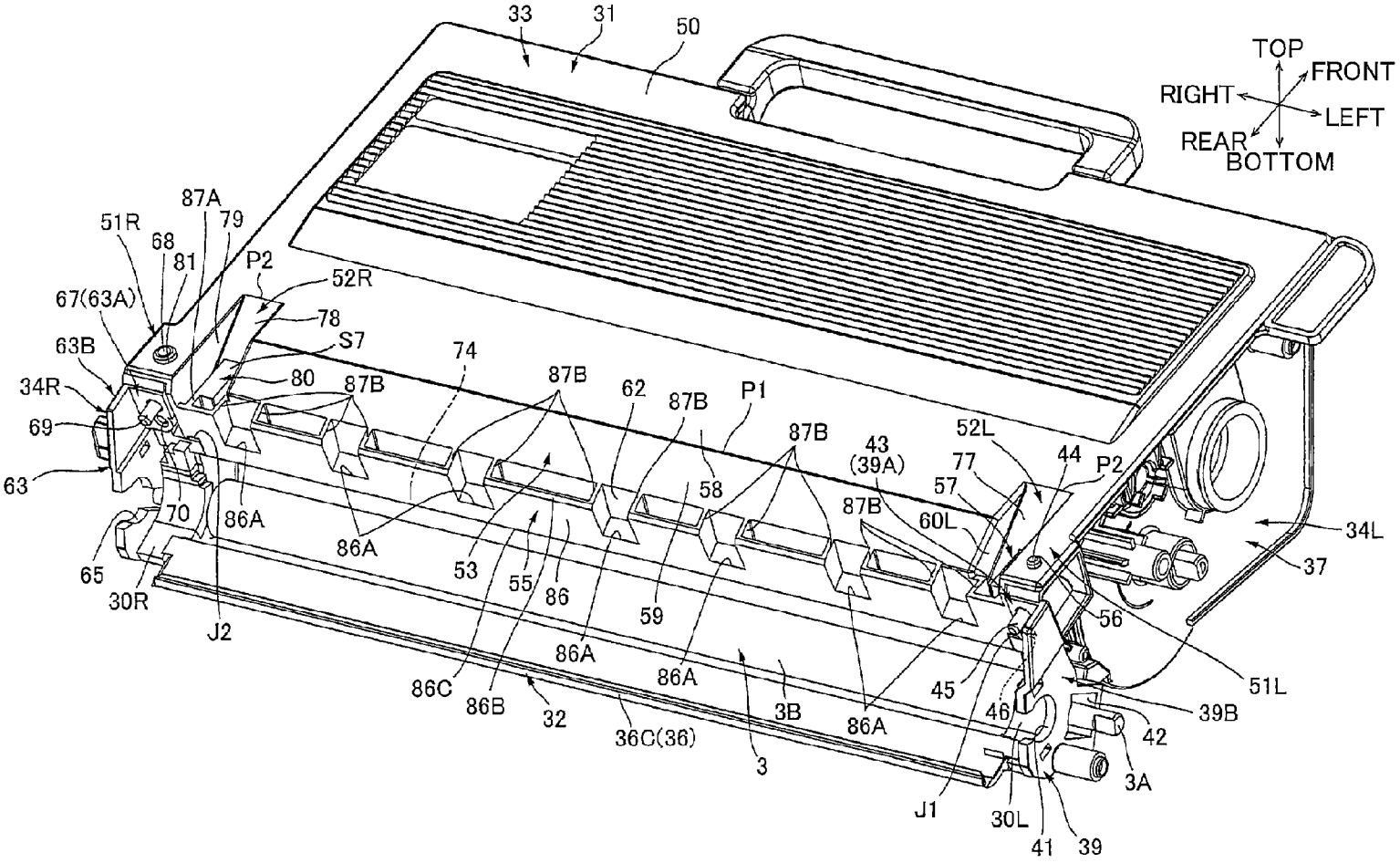
FIG. 13 is a perspective view showing an assembled state of a supply roller to the cartridge frame.
Figure 14:
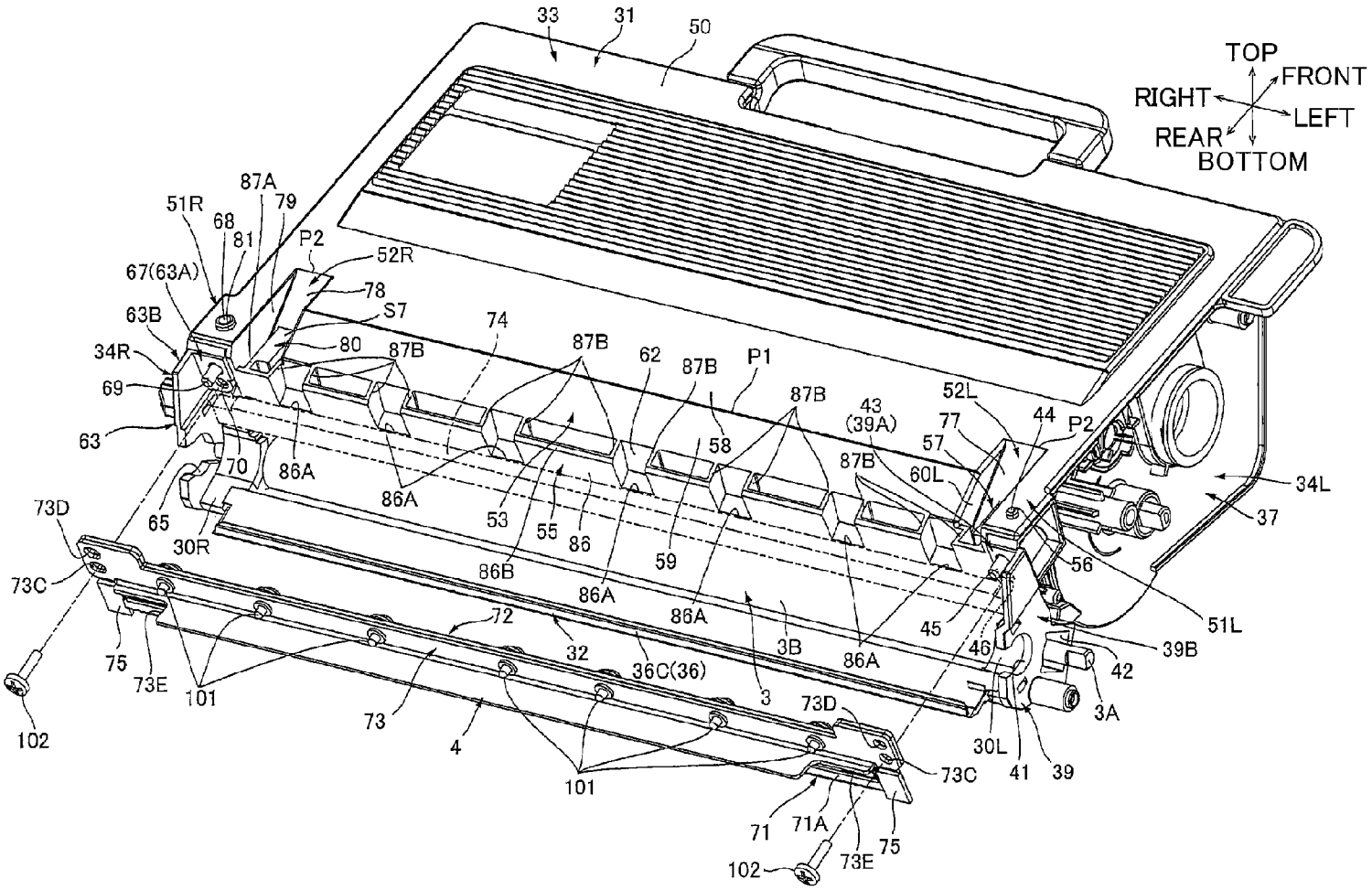
FIG. 14 is an explanatory view for explaining an assembly of the blade to the cartridge frame.

Next, in order to assemble the developing cartridge 1, the blade 4 is assembled to the developing frame 31 to which the supply roller 3, the first side seal 30L, and the first side seal 30R have been assembled, as illustrated in FIGS. 13 and 14.

In order to assemble the blade 4 to the developing frame 31, the blade 4 is first aligned with the blade support portion 55 of the cover frame 33, the blade attachment portion 43 of the left wall 34L, and the blade attachment portion 67 of the right wall 34R at a position rearward thereof. Then, the positioning boss 45 of the left wall 34L is inserted into the left positioning boss insertion hole 72D of the first support plate 72 and the left positioning boss insertion hole 73D of the second support plate 73. Further, the positioning boss 69 of the right wall 34R is inserted into the right positioning boss insertion hole 72D of the first support plate 72 and the right positioning boss insertion hole 73D of the second support plate 73.

Thus, the blade 4 is supported by the base frame 32 at a position below the inclined wall 59 of the cover frame 33. That is, the inclined wall 59 is positioned separated upward from the base frame 32 further than the blade 4 from the base frame 32.

At this time, as indicated by imaginary lines of FIG. 14, a left end portion of the blade seal 74 of the blade 4 is placed rearward of and faces a joint J1 (see FIG. 13) between the left inclined portion 52L and the inclined portion 40 of the left wall 34L. Further, a right end portion of the blade seal 74 is placed rearward of and faces a joint J2 (see FIG. 13) between the right inclined portion 52R and the inclined portion 64 of the right wall 34R. In addition, the upper edge 71D (see FIG. 12) of the blade body 71 is positioned upward of the joint J1 and the joint J2 and downward of the upper edge 86B of the opposing wall 86 of the base frame 32.

Next, in order to assemble the blade 4 to the developing frame 31, a screw 102 is inserted into the left screw insertion hole 73C of the second support plate 73, the left second screw insertion hole 71C of the blade body 71, and the left second screw insertion hole 72C of the first support plate 72, and fixed to the screw hole 46 of the left wall 34L. Further, another screw 102 is inserted into the right screw insertion hole 73C of the second support plate 73, the right second screw insertion hole 71C of the blade body 71, and the right second screw insertion hole 72C of the first support plate 72, and fixed to the screw hole 70 of the right wall 34R.

This completes the assembly of the blade 4 to the developing frame 31. When the blade 4 is completely assembled to the developing frame 31, the blade seal 74 is compressed between the blade body 71 and the opposing wall 86 of the developing frame 31.

Subsequently, the developing roller 2 is assembled to the developing frame 31 at a position rearward of the blade 4 as illustrated in FIG. 1. This completes the assembly of the developing cartridge 1.

As illustrated in FIG. 3, a developing chamber 120 is a space defined by the center portion 53 of the cover frame 33, the attachment portion 39 of the left wall 34L of the base frame 32, the attachment portion 63 of the right wall 34R of the base frame 32, the second portion 36B of the lower wall 36 of the base frame 32, the supply roller 3, the developing roller 2, and the blade 4. The developing chamber 120 is in communication with the toner accommodating portion 5.

5. Image Forming Operation

As described above, when an image forming operation is started, the toner accommodated in the toner accommodating portion 5 is conveyed to the developing chamber 120 to be carried on the developing roller 2.

At this time, as indicated by an arrow of FIG. 3, toner scraped off from the developing roller 2 by the blade 4 and toner not carried on the developing roller 2 are extruded by the toner further supplied from the toner accommodating portion 5 to be returned to the toner accommodating portion 5 through the internal space defined by the center portion 53. Thus, toner can be circulated in the developing chamber 120.

6. Operational Advantages (1) According to the developing cartridge 1 described above, as illustrated in FIGS. 1 and 3, the center portion 53 of the cover frame 33 is positioned inward of the inclined wall 77 and the inclined wall 78 of the cover frame 33, and has the parallel wall 58 and the inclined wall 59. The inclined wall 59 is positioned closer to the developing roller 2 than the parallel wall 58 to the developing roller 2. The lower surface 59A of the inclined wall 59 forms the obtuse angle θ2 with the lower surface 58A of the parallel wall 58. The lower surface 59A of the inclined wall 59 is positioned separated upward from the base frame 32 further than the inclined wall 77 and the inclined wall 78 from the base frame 32. In other words, the lower surface 59A of the inclined wall 59 forms the obtuse angle θ2 with the lower surface 58A of the parallel wall 58, and is positioned separated upward from the base frame 32 further than the inclined wall 77 and the inclined wall 78 from the base frame 32 with respect to a direction perpendicular to the lower surface 59A of the inclined wall 59. Put another way, the lower surface 59A of the inclined wall 59 forms the obtuse angle θ2 with the lower surface 58A of the parallel wall 58, and is positioned outward relative to the inclined wall 77 and the inclined wall 78 with respect to the direction perpendicular to the lower surface 59A of the inclined wall 59.

Hence, a space inside the developing chamber 120 can be ensured at a position closer to a left-right center portion of the developing roller 2 than the inclined wall 77 and the inclined wall 78 to the left-right center portion of the developing roller 2.

As a result, the toner can be easily circulated inside the developing chamber 120.

Accordingly, the toner can be suppressed from being deposited near the developing roller 2. Therefore, the printing speed can be further increased.

Further, an amount of the toner retained in the developing chamber 120 can also be increased.

(2) According to the developing cartridge 1, as illustrated in FIG. 3, the obtuse angle θ2 formed between the lower surface 59A of the inclined wall 59 and the lower surface 58A of the parallel wall 58 is equal to or larger than 120° and smaller than 180° (specifically, 156°).

Hence, a space inside the developing chamber 120 can be further ensured.

(3) According to the developing cartridge 1, as illustrated in FIGS. 3 and 8, the obtuse angle θ2 formed between the lower surface 59A of the inclined wall 59 and the lower surface 58A of the parallel wall 58 is larger than the obtuse angle θ1 (specifically, 150°) formed between the lower surface 77A of the inclined wall 77 and the lower surface 50A of the main body portion 50. That is, the obtuse angle θ2 is 1.04 times as large as the obtuse angle θ1. The obtuse angle θ2 may be 1.10 times as large as the obtuse angle θ1. The obtuse angle θ2 may also be 1.20 times as large as the obtuse angle θ1.

Hence, a space inside the developing chamber 120 can be further ensured.

(4) According to the developing cartridge 1, as illustrated in FIG. 1, the continuous portion P1 between the parallel wall 58 and the inclined wall 59 is closer to the developing roller 2 than the continuous portion P2 between the inclined wall 77 or the inclined wall 78 and the main body portion 50 to the developing roller 2 with respect to the front-rear direction.

Hence, a space inside the developing chamber 120 can be ensured in the vicinity of the developing roller 2.

As a result, the toner can be more reliably suppressed from being deposited near the developing roller 2.

(5) According to the developing cartridge 1, as illustrated in FIGS. 5 and 7, the cover frame 33 can be assembled to the base frame 32 by inserting the engagement boss 44 of the left wall 34L into the engagement hole 56 of the left engagement portion 51L and inserting the engagement boss 68 of the right wall 34R into the engagement hole 81 of the right engagement portion 51R.

Hence, the cover frame 33 can be smoothly melt-bonded to the base frame 32 in a state where the cover frame 33 is assembled to the base frame 32.

(6) According to the developing cartridge 1, as illustrated in FIG. 5, the blade attachment portion 43 is positioned further leftward than the inclined portion 40 and lower than the upper surface S1 of the left wall 34L. Further, the blade attachment portion 67 is positioned further rightward than the inclined portion 64 and lower than the upper surface S3 of the right wall 34R.

Hence, the blade 4 can be supported at a position closer to the base frame 32.

(7) According to the developing cartridge 1, as illustrated in FIGS. 1 and 3, the inclined wall 59 is positioned separated upward from the base frame 32 further than the blade 4 from the base frame 32.

Hence, a space inside the developing chamber 120 can be expanded to a space positioned farther away from the blade 4 with respect to the vertical direction.

As a result, a space inside the developing chamber 120 can be further ensured.

(8) According to the developing cartridge 1, as illustrated in FIGS. 1 and 12, the upper edge 71D of the blade body 71 is positioned upward of the joint J1 and the joint J2 (see FIG. 7) and downward of the upper edge 86B of the opposing wall 86 of the cover frame 33.

Hence, the blade body 71 can be arranged to face the joint J1 and the joint J2.

Accordingly, as illustrated in FIG. 14, the joint J1 and the joint J2 can be sealed by the blade seal 74 disposed between the blade body 71 and the opposing wall 86.

As a result, the joint J1 and the joint J2 can be sealed with a simple configuration.

(9) According to the developing cartridge 1, as illustrated in FIG. 14, the blade seal 74 overlaps the joint J1 and the joint J2.

Hence, the joint J1 and the joint J2 can be sealed reliably by the blade seal 74 with a simple configuration.

(10) According to the developing cartridge 1, as illustrated in FIG. 5, the blade attachment portion 43 is provided with the positioning boss 45 and the screw hole 46 separately. Further, the blade attachment portion 67 is provided with the positioning boss 69 and the screw hole 70 separately.

Hence, the respective screws 102 can be prevented from contacting the positioning boss 45 and the positioning boss 69 when the screws 102 are fixed to the screw hole 46 and the screw hole 70.

Accordingly, the positioning boss 45 and the positioning boss 69 can be prevented from being crushed when the respective screws 102 are fixed to the screw hole 46 and the screw hole 70 for attaching the blade 4 to the base frame 32.

As a result, even when the blade 4 is detached from the base frame 32 during a maintenance operation for the developing cartridge 1, the blade 4 can be again attached to the base frame 32 while being fixed in position through the positioning boss 45 and the positioning boss 69.

7. Modifications

While the description has been made in detail with reference to the embodiments thereof, it would be apparent to those skilled in the art that many modifications and variations may be made therein without departing from the spirit of the above-described embodiment.

In the above-described embodiment, the blade body 71 is sandwiched between the first support plate 72 and the second support plate 73. However, the configuration of the blade 4 is not particularly limited. For example, the blade body 71 may be welded to the first support plate 72 and the second support plate 73. Further, the blade body 71 may be a metal plate without the contact member 71A.

Further, in the above-described embodiment, the blade seal 74 is fixed to the blade body 71. However, the blade seal 74 may be fixed to the developing frame 31.

Further, in the above-described embodiment, the developing roller 2 may be directly supported by the left wall 34L and the right wall 34R of the developing frame 31. Further, the developing roller 2 may be indirectly supported by the left wall 34L and the right wall 34R of the developing frame 31, for example, through bearings.

Note that the front-rear direction is an example of a first direction. The left-right direction is an example of an axial direction.

Further, the base frame 32 is an example of a first frame. The attachment portion 39 of the left wall 34L, the attachment portion 63 of the right wall 34R, the second portion 36B of the lower wall 36, and the third portion 36C of the lower wall 36 constitute a developing roller support portion. A portion of the upper surface S1 of the left wall 34L contacting the first melt-bonding rib 91 is an example of a first melt-bonding (or welding) surface and a first base welding surface. Further, a portion of the upper surface S3 of the right wall 34R contacting the first melt-bonding rib 91 is an example of the first melt-bonding (or welding) surface and a third base welding surface. The upper surface S2 of the inclined portion 40 is an example of a second melt-bonding (or welding) surface and a second base welding surface. Further, the upper surface S4 of the inclined portion 64 is an example of the second melt-bonding (or welding) surface and a fourth base welding surface. The engagement boss 44 of the left wall 34L or the engagement boss 68 of the right wall 34R is an example of a first engagement portion. The engagement boss 44 of the left wall 34L is an example of a first base engagement portion. The engagement boss 68 of the right wall 34R is an example of a second base engagement portion. The blade attachment portion 43 of the left wall 34L or the blade attachment portion 67 of the right wall 34R is an example of a support portion. The blade attachment portion 43 of the left wall 34L is an example of a first support portion. The blade attachment portion 67 of the right wall 34R is an example of a second support portion. The positioning boss 45 of the left wall 34L or the positioning boss 69 of the right wall 34R is an example of a boss. The screw hole 46 of the left wall 34L or the screw hole 70 of the right wall 34R is an example of a hole.

Further, the cover frame 33 is an example of a second frame. A portion of the lower surface 50A of the main body portion 50 including the first melt-bonding rib 91 is an example of a third melt-bonding (or welding) surface, a first cover welding surface, and a third cover welding surface. The lower surface 77A of the inclined wall 77 is an example of a fourth melt-bonding (or welding) surface and a second cover welding surface. Further, the lower surface 78A of the inclined wall 78 is an example of the fourth melt-bonding (or welding) surface and a fourth cover welding surface. The lower surface 58A of the parallel wall 58 is an example of a first center surface. The lower surface 59A of the inclined wall 59 is an example of a second center surface. The lower surface 58A of the parallel wall 58 and the lower surface 59A of the inclined wall 59 constitute a center surface. The engagement hole 56 of the left engagement portion 51L or the engagement hole 81 of the right engagement portion 51R is an example of a second engagement portion. The engagement hole 56 of the left engagement portion 51L is an example of a first cover engagement portion. The engagement hole 81 of the right engagement portion 51R is an example of a second cover engagement portion. The rear surface of the opposing wall 86 is an example of a blade support surface. The lower edge 86C of the opposing wall 86 is an example of a third edge of the blade support surface and a first edge of the blade support surface. The upper edge 86B of the opposing wall 86 is an example of a fourth edge of the blade support surface and a second edge of the blade support surface.

Further, the lower edge 71E of the blade body 71 is an example of a first edge of the blade. The upper edge 71D of the blade body 71 is an example of a second edge of the blade. The blade seal 74 is an example of a seal.

What is claimed is:

1. A developing cartridge comprising:

a developing roller having an axis extending in an axial direction and an axial center region in the axial direction;

a first frame including a toner accommodating portion and a developing roller support portion, the toner accommodating portion having an edge portion extending in a first direction perpendicular to the axial direction, the developing roller support portion supporting the developing roller and being in communication with the toner accommodating portion, the first frame comprising:

a first melt-bonding surface extending along the edge portion of the toner accommodating portion; and a second melt-bonding surface positioned closer to the developing roller than the first melt-bonding surface to the developing roller, the second melt-bonding surface forming a first obtuse angle with the first melt-bonding surface; and a second frame covering the toner accommodating portion and the developing roller support portion, the second frame being melt-bonded to the first frame, the second frame comprising:

a third melt-bonding surface facing the first melt-bonding surface and melt-bonded to the first melt-bonding surface;

a fourth melt-bonding surface facing the second melt-bonding surface and melt-bonded to the second melt-bonding surface; and a center surface facing the first frame and extending in the axial direction, the center surface being positioned closer to the axial center region of the developing roller than the fourth melt-bonding surface to the axial center region of the developing roller with respect to the axial direction, the center surface having a first center surface extending in the first direction and a second center surface positioned closer to the developing roller than the first center surface to the developing roller with respect to the first direction, the second center surface forming a second obtuse angle with the first center surface, the second center surface being separated from the first frame farther than the fourth melt-bonding surface from the first frame with respect to a direction perpendicular to the fourth melt-bonding surface, wherein the second obtuse angle formed between the first center surface and the second center surface is equal to or greater than 120° and smaller than 180°.

2. The developing cartridge according to claim 1, wherein the third melt-bonding surface forms a third obtuse angle with the fourth melt-bonding surface, and wherein the second obtuse angle formed between the first center surface and the second center surface is greater than the third obtuse angle formed between the third melt-bonding surface and the fourth melt-bonding surface.

3. The developing cartridge according to claim 1, wherein the first center surface is continuous to the second center surface at a first continuous portion, the third melt-bonding surface being continuous to the fourth melt-bonding surface at a second continuous portion, the first continuous portion being positioned closer to the developing roller than the second continuous portion to the developing roller.

4. The developing cartridge according to claim 1, wherein first frame includes a first engagement portion positioned farther from the center surface than the second melt-bonding surface from the center surface with respect to the axial direction, and wherein the second frame includes a second engagement portion positioned farther from the center surface than the fourth melt-bonding surface from the center surface with respect to the axial direction, the second engagement portion engaging with the first engagement portion.

5. The developing cartridge according to claim 1, further comprising a blade extending in the axial direction and contacting the developing roller, the blade having an axial end in the axial direction, wherein the first frame includes a support portion supporting the axial end of the blade, the support portion being positioned farther from the center surface than the second melt-bonding surface from the center surface with respect to the axial direction, the support portion being positioned farther from the second frame than the first melt-bonding surface from the second frame with respect to a second direction perpendicular to the first melt-bonding surface.

6. The developing cartridge according to claim 5, wherein the blade faces the second frame in the first direction, and wherein the second center surface is positioned farther from the first frame than the blade from the first frame with respect to the second direction.

7. The developing cartridge according to claim 5, wherein the second frame further comprises a blade support surface supporting the blade, wherein the second melt-bonding surface and the fourth melt-bonding surface extend to the blade support surface in the first direction, the fourth melt-bonding surface providing a joint in cooperation with the second melt-bonding surface at the blade support surface, wherein the blade has a first edge and a second edge in the second direction, the second edge being farther from the first frame than the first edge from the first frame with respect to the second direction, wherein the blade support surface has a third edge and a fourth edge in the second direction, the fourth edge being farther from the first frame than the third edge from the first frame with respect to the second direction, and wherein the second edge is positioned farther from the first frame than the joint from the first frame with respect to the second direction, the second edge being positioned closer to the first frame than the fourth edge to the first frame with respect to the second direction.

8. The developing cartridge according to claim 5, wherein the second frame further comprises:

a blade support surface supporting the blade; and a seal provided on the blade support surface at a position between the blade and the second frame, wherein the second melt-bonding surface and the fourth melt-bonding surface extend to the blade support surface in the first direction, the fourth melt-bonding surface providing a joint in cooperation with the second melt-bonding surface at the blade support surface, the seal overlapping the joint.

9. The developing cartridge according to claim 5, further comprising a screw for fixing the blade to the first frame, wherein the support portion has a boss for positioning the blade relative to the first frame, and a hole formed at a position separate from the boss and in which the screw is inserted.

10. The developing cartridge according to claim 1, wherein the second obtuse angle formed between the first center surface and the second center surface is equal to or greater than 130° and equal to or smaller than 170°.

11. The developing cartridge according to claim 10, wherein the second obtuse angle formed between the first center surface and the second center surface is equal to or greater than 140° and equal to or smaller than 160°.

12. A developing cartridge comprising:

a developing roller;

a base frame supporting a developing roller and having a box shape, the base frame comprising:

a first base welding surface;

a second base welding surface positioned closer to the developing roller than the first base welding surface to the developing roller, the second base welding surface forming a first obtuse angle with the first base welding surface;

a third base welding surface; and a fourth base welding surface positioned closer to the developing roller than the third base welding surface to the developing roller, the fourth base welding surface forming the first obtuse angle with the third base welding surface; and a cover frame having a flat plate shape, the cover frame comprising:

a first cover welding surface facing the first base welding surface and welded to the first base welding surface;

a second cover welding surface facing the second base welding surface and welded to the second base welding surface, the second cover welding surface forming a third obtuse angle with the first cover welding surface;

a third cover welding surface facing the third base welding surface and welded to the third base welding surface;

a fourth cover welding surface facing the fourth base welding surface and welded to the fourth base welding surface, the fourth cover welding surface forming the third obtuse angle with the third cover welding surface;

a first center surface facing the base frame and positioned between the second cover welding surface and the fourth cover welding surface; and a second center surface facing the base frame and positioned between the second cover welding surface and the fourth cover welding surface and closer to the developing roller than the first center surface to the developing roller, the second center surface forming a second obtuse angle with the first center surface, the second center surface being separated from the base frame farther than the second cover welding surface from the base frame with respect to a direction perpendicular to the second cover welding surface, wherein the second obtuse angle is greater than the third obtuse angle.

13. The developing cartridge according to claim 12, wherein the second obtuse angle formed between the first center surface and the second center surface is equal to or greater than 120° and smaller than 170°.

14. The developing cartridge according to claim 12, wherein base frame includes a first base engagement portion and a second base engagement portion, the second base welding surface being positioned between the second center surface of the cover frame and the first base engagement portion, the fourth base welding surface being positioned between the second center surface of the cover frame and the second base engagement portion; and wherein the cover frame includes a first cover engagement portion facing the first base engagement portion of the base frame and a second cover engagement portion facing the second base engagement portion of the base frame.

15. The developing cartridge according to claim 12, further comprising a blade contacting the developing roller, wherein the base frame includes a first support portion and a second support portion, the first support portion and the second support portion supporting the blade, the second base welding surface being positioned between the second center surface of the cover frame and the first support portion, the fourth base welding surface being positioned between the second center surface of the cover frame and the second support portion.

16. The developing cartridge according to claim 15, wherein the cover frame further comprises a blade support surface supporting the blade, the blade support surface having a first edge and a second edge opposite to the first edge, the second edge being farther from the developing roller than the first edge from the developing roller, and wherein the second cover welding surface and the fourth cover welding surface extend from the second edge of the blade support surface.

17. The developing cartridge according to claim 15, wherein the cover frame further comprises a blade support surface supporting the blade, the developing cartridge further comprising a seal provided on the blade support surface at a position between the blade and the cover frame, wherein the second cover welding surface and the fourth cover welding surface provides a joint at the blade support surface, the seal overlapping the joint.

18. The developing cartridge according to claim 12, wherein the second obtuse angle formed between the first center surface and the second center surface is equal to or greater than 130° and equal to or smaller than 170°.

19. The developing cartridge according to claim 12, wherein the second obtuse angle formed between the first center surface and the second center surface is equal to or greater than 140° and equal to or smaller than 160°.

20. The developing cartridge according to claim 13, wherein the first obtuse angle formed between the second base welding surface and the first base welding surface is equal to or great than 140° and equal to or smaller than 180°.

21. A developing cartridge comprising:

a developing roller having an axis extending in an axial direction and an axial center region in the axial direction;

a first frame including a toner accommodating portion and a developing roller support portion, the toner accommodating portion having an edge portion extending in a first direction perpendicular to the axial direction, the developing roller support portion supporting the developing roller and being in communication with the toner accommodating portion, the first frame comprising:

a first melt-bonding surface extending along the edge portion of the toner accommodating portion; and a second melt-bonding surface positioned closer to the developing roller than the first melt-bonding surface to the developing roller, the second melt-bonding surface forming a first obtuse angle with the first melt-bonding surface;

a second frame covering the toner accommodating portion and the developing roller support portion, the second frame being melt-bonded to the first frame, the second frame comprising:

a third melt-bonding surface facing the first melt-bonding surface and melt-bonded to the first melt-bonding surface;

a fourth melt-bonding surface facing the second melt-bonding surface and melt-bonded to the second melt-bonding surface; and a center surface facing the first frame and extending in the axial direction, the center surface being positioned closer to the axial center region of the developing roller than the fourth melt-bonding surface to the axial center region of the developing roller with respect to the axial direction, the center surface having a first center surface extending in the first direction and a second center surface positioned closer to the developing roller than the first center surface to the developing roller with respect to the first direction, the second center surface forming a second obtuse angle with the first center surface, the second center surface being separated from the first frame farther than the fourth melt-bonding surface from the first frame with respect to a direction perpendicular to the fourth melt-bonding surface;

a blade extending in the axial direction and contacting the developing roller, the blade having an axial end in the axial direction; and a screw for fixing the blade to the first frame, wherein the first frame includes a support portion supporting the axial end of the blade, the support portion being positioned farther from the center surface than the second melt-bonding surface from the center surface with respect to the axial direction, the support portion being positioned farther from the second frame than the first melt-bonding surface from the second frame with respect to a second direction perpendicular to the first melt-bonding surface, and wherein the support portion has a boss for positioning the blade relative to the first frame, and a hole formed at a position separate from the boss and in which the screw is inserted.

* * * * *